US007870912B2

(12) United States Patent
Dolgin et al.

(10) Patent No.: US 7,870,912 B2
(45) Date of Patent: Jan. 18, 2011

(54) CENTRALIZER-BASED SURVEY AND NAVIGATION DEVICE AND METHOD

(75) Inventors: Benjamin Dolgin, Alexandria, VA (US); William Suliga, Manassas, VA (US); Brett Goldstein, Kensington, MD (US); David Vickerman, Lothian, MD (US); John L. Hill, III, Woodbridge, VA (US); Joram Shenhar, Fairfax, VA (US); Keith Grindstaff, Stafford, VA (US); Steven A. Cotten, Dumfries, VA (US)

(73) Assignee: Raytheon UTD, Incorporated, Springfield, VA (US)

( * ) Notice: Subject to any disclaimer, the term of this patent is extended or adjusted under 35 U.S.C. 154(b) by 0 days.

(21) Appl. No.: 12/542,529

(22) Filed: Aug. 17, 2009

(65) Prior Publication Data

US 2010/0038068 A1 Feb. 18, 2010

Related U.S. Application Data

(63) Continuation of application No. 11/302,384, filed on Dec. 14, 2005, now Pat. No. 7,584,808.

(60) Provisional application No. 60/635,477, filed on Dec. 14, 2004.

(51) Int. Cl.
*E21B 47/024* (2006.01)

(52) U.S. Cl. ..... 175/45

(58) Field of Classification Search ..... 175/45, 175/61, 82

See application file for complete search history.

(56) References Cited

U.S. PATENT DOCUMENTS

| | | | | |
|---|---|---|---|---|
| 2,100,418 | A * | 11/1937 | Welikanov | 175/45 |
| 4,399,692 | A | 8/1983 | Hulsing, II et al. | |
| 4,629,012 | A | 12/1986 | Schuh | |
| 4,823,125 | A | 4/1989 | Rorden et al. | |
| 5,603,386 | A | 2/1997 | Webster | |
| 5,758,723 | A | 6/1998 | Saucier et al. | |
| 5,947,213 | A | 9/1999 | Angle et al. | |
| 6,459,092 | B2 | 10/2002 | Cho et al. | |
| 6,742,604 | B2 | 6/2004 | Brazil et al. | |
| 2002/0003040 | A1 | 1/2002 | Brunet | |
| 2003/0183383 | A1 | 10/2003 | Guerrero | |
| 2004/0141415 | A1 | 7/2004 | Redding et al. | |
| 2005/0269083 | A1 | 12/2005 | Burris et al. | |
| 2007/0144782 | A1 | 6/2007 | Krueger et al. | |
| 2007/0221375 | A1 | 9/2007 | Baron et al. | |

OTHER PUBLICATIONS

International Preliminary Report on Patentability and Written Opinion, Mar. 12, 2009.

* cited by examiner

*Primary Examiner*—Daniel P Stephenson
(74) *Attorney, Agent, or Firm*—Dickstein Shapiro LLP

(57) ABSTRACT

A Centralizer based Survey and Navigation (CSN) device designed to provide borehole or passageway position information. The CSN device can include one or more displacement sensors, centralizers, an odometry sensor, a borehole initialization system, and navigation algorithm implementing processor(s). Also, methods of using the CSN device for in-hole survey and navigation.

23 Claims, 24 Drawing Sheets

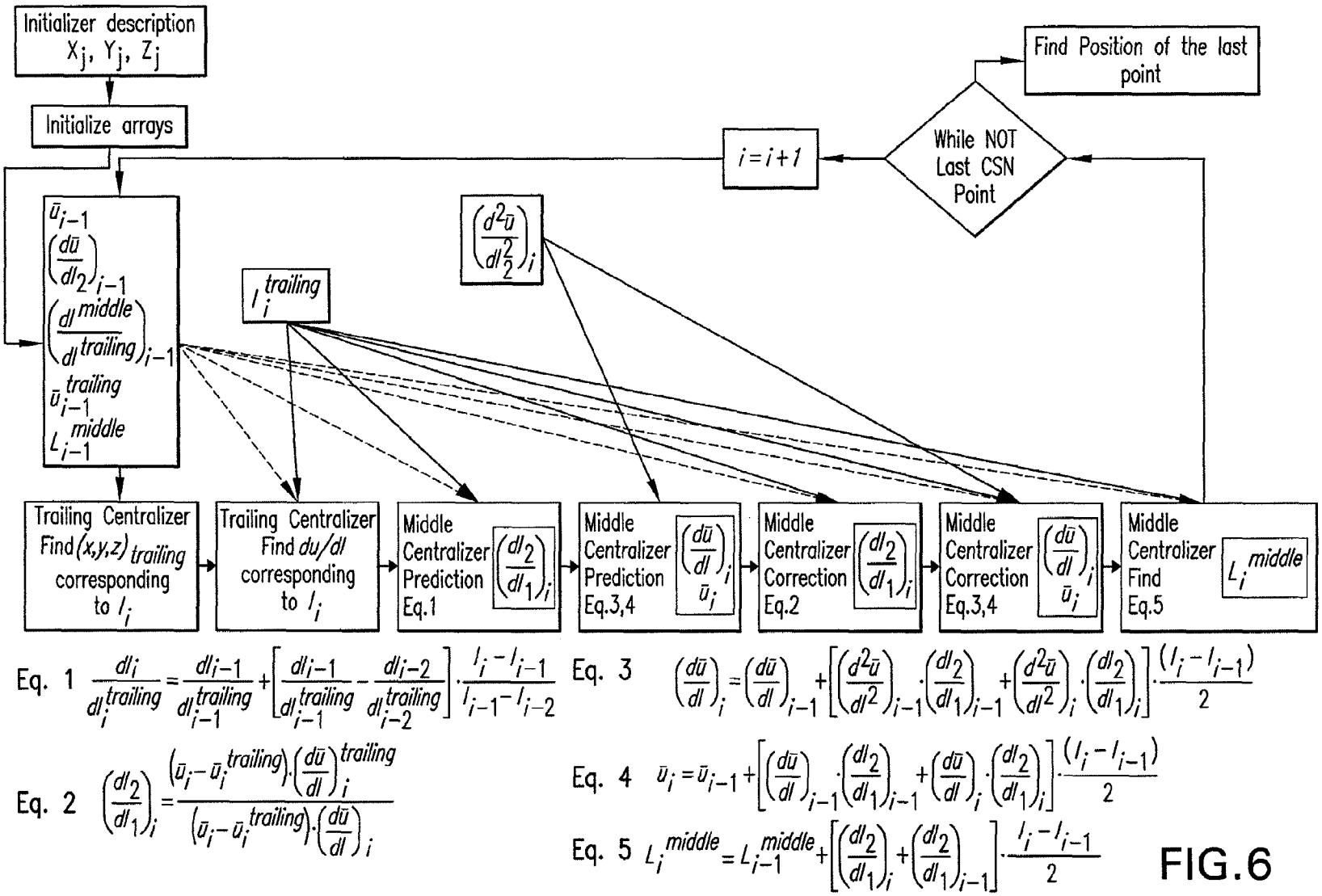

Eq. 1 $$\frac{dl_i}{dl_i^{trailing}} = \frac{dl_{i-1}}{dl_{i-1}^{trailing}} + \left[\frac{dl_{i-1}}{dl_{i-1}^{trailing}} - \frac{dl_{i-2}}{dl_{i-2}^{trailing}}\right] \cdot \frac{l_i - l_{i-1}}{l_{i-1} - l_{i-2}}$$

Eq. 2 $$\left(\frac{dl_2}{dl_1}\right)_i = \frac{(\bar{u}_i - \bar{u}_i^{trailing}) \cdot \left(\frac{d\bar{u}}{dl}\right)_i^{trailing}}{(\bar{u}_i - \bar{u}_i^{trailing}) \cdot \left(\frac{d\bar{u}}{dl}\right)_i}$$

Eq. 3 $$\left(\frac{d\bar{u}}{dl}\right)_i = \left(\frac{d\bar{u}}{dl}\right)_{i-1} + \left[\left(\frac{d^2\bar{u}}{dl^2}\right)_{i-1} \cdot \left(\frac{dl_2}{dl_1}\right)_{i-1} + \left(\frac{d^2\bar{u}}{dl^2}\right)_i \cdot \left(\frac{dl_2}{dl_1}\right)_i\right] \cdot \frac{(l_i - l_{i-1})}{2}$$

Eq. 4 $$\bar{u}_i = \bar{u}_{i-1} + \left[\left(\frac{d\bar{u}}{dl}\right)_{i-1} \cdot \left(\frac{dl_2}{dl_1}\right)_{i-1} + \left(\frac{d\bar{u}}{dl}\right)_i \cdot \left(\frac{dl_2}{dl_1}\right)_i\right] \cdot \frac{(l_i - l_{i-1})}{2}$$

Eq. 5 $$L_i^{middle} = L_{i-1}^{middle} + \left[\left(\frac{dl_2}{dl_1}\right)_i + \left(\frac{dl_2}{dl_1}\right)_{i-1}\right] \cdot \frac{l_i - l_{i-1}}{2}$$

FIG. 6

CENTRALIZER-BASED SURVEY AND NAVIGATION DEVICE AND METHOD

CROSS REFERENCE TO RELATED APPLICATIONS

The present application is a continuation of U.S. application Ser. No. 11/302,384, filed Dec. 14, 2005, now U.S. Pat. No. 7,584,808 which claims the benefit of Provisional Application No. 60/635,477, filed Dec. 14, 2004, the disclosures of which are herewith incorporated by reference in their entirety.

FIELD OF THE INVENTION

The present invention relates, but is not limited, to a method and apparatus for accurately determining in three dimensions information on the location of an object in a passageway and/or the path taken by a passageway, e.g., a borehole or tube.

BACKGROUND OF THE INVENTION

The drilling industry has recognized the desirability of having a position determining system that can be used to guide a drilling head to a predestined target location. There is a continuing need for a position determining system that can provide accurate position information on the path of a borehole and/or the location of a drilling head at any given time as the drill pipe advances. Ideally, the position determining system would be small enough to fit into a drill pipe so as to present minimal restriction to the flow of drilling or returning fluids and accuracy should be as high as possible.

Several systems have been devised to provide such position information. Traditional guidance and hole survey tools such as inclinometers, accelerometers, gyroscopes and magnetometers have been used. One problem facing all of these systems is that they tend to be too large to allow for a "measurement while drilling" for small diameter holes. In a "measurement while drilling" system, it is desirable to incorporate a position locator device in the drill pipe, typically near the drilling head, so that measurements may be made without extracting the tool from the hole. The inclusion of such instrumentation within a drill pipe considerably restricts the flow of fluids. With such systems, the drill pipe diameter and the diameter of the hole must often be greater than 4 inches to accommodate the position measuring instrumentation, while still allowing sufficient interior space to provide minimum restriction to fluid flow. Systems based on inclinometers, accelerometers, gyroscopes, and/or magnetometers are also incapable of providing a high degree of accuracy because they are all influenced by signal drift, vibrations, or magnetic or gravitational anomalies. Errors on the order of 1% or greater are often noted.

Some shallow depth position location systems are based on tracking sounds or electromagnetic radiation emitted by a sonde near the drilling head. In addition to being depth limited, such systems are also deficient in that they require a worker to carry a receiver and walk the surface over the drilling head to detect the emissions and track the drilling head location. Such systems cannot be used where there is no worker access to the surface over the drilling head or the ground is not sufficiently transparent to the emissions.

A system and method disclosed in U.S. Pat. No. 5,193,628 ("the '628 patent") to Hill, III, et al., which is hereby incorporated by reference, was designed to provide a highly accurate position determining system small enough to fit within drill pipes of diameters substantially smaller than 4 inches and configured to allow for smooth passage of fluids. This system and method is termed "POLO," referring to POsition LOcation technology. The system disclosed in the '628 patent successively and periodically determines the radius of curvature and azimuth of the curve of a portion of a drill pipe from axial strain measurements made on the outer surface of the drill pipe as it passes through a borehole or other passageway. Using successively acquired radius of curvature and azimuth information, the '628 patent system constructs on a segment-by-segment basis, circular arc data representing the path of the borehole and which also represents, at each measurement point, the location of the measuring strain gauge sensors. If the sensors are positioned near the drilling head, the location of the drilling head can be obtained.

The '628 patent system and method has application for directional drilling and can be used with various types of drilling apparatus, for example, rotary drilling, water jet drilling, down hole motor drilling, and pneumatic drilling. The system is useful in directional drilling such as well drilling, reservoir stimulation, gas or fluid storage, routing of original piping and wiring, infrastructure renewal, replacement of existing pipe and wiring, instrumentation placement, core drilling, cone penetrometer insertion, storage tank monitoring, pipe jacking, tunnel boring and in other related fields.

The '628 patent also provides a method for compensating for rotation of the measuring tube during a drilling operation by determining, at each measurement position, information concerning the net amount of rotation relative to a global reference, if any, of the measuring tube as it passes through the passageway and using the rotation information with the strain measurement to determine the azimuth associated with a measured local radius of curvature relative to the global reference.

While the '628 patent provides great advantages, there are some aspects of the system and method that could be improved.

SUMMARY

The Centralizer-based Survey and Navigation (CSN) device is designed to provide borehole or passageway position information. The device is suitable for both closed traverse surveying (referred to as survey) and open traverse surveying or navigation while drilling (referred to as navigation). The CSN device can consist of a sensor string comprised of one or more segments having centralizers, which position the segment(s) within the passageway, and at least one metrology sensor, which measures the relative positions and orientation of the centralizers, even with respect to gravity. The CSN device can also have at least one odometry sensor, an initialization system, and a navigation algorithm implementing processor(s). The number of centralizers in the sensor string should be at least three. Additional sensors, such as inclinometers, accelerometers, and others can be included in the CSN device and system.

There are many possible implementations of the CSN, including an exemplary embodiment relating to an in-the-hole CSN assembly of a sensor string, where each segment can have its own detector to measure relative positions of centralizers, its own detector that measures relative orientation of the sensor string with respect to gravity, and/or where the partial data reduction is performed by a processor placed inside the segment and high value data is communicated to the navigation algorithm processor through a bus.

Another exemplary embodiment relates to a CSN device utilizing a sensor string segment which can utilize capacitance proximity detectors and/or fiber optic proximity detectors and/or strain gauges based proximity detectors that measure relative positions of centralizers with respect to a reference straight metrology body or beam.

Another exemplary embodiment relates to a CSN device utilizing an angular metrology sensor, which has rigid beams as sensor string segments that are attached to one or more centralizers. These beams are connected to each other using a flexure-based joint with strain gauge instrumented flexures and/or a universal joint with an angle detector such as angular encoder. The relative positions of the centralizers are determined based on the readings of the said encoders and/or strain gauges.

Another exemplary embodiment relates to a CSN device utilizing a strain gauge instrumented bending beam as a sensor string segment, which can use the readings of these strain gauges to measure relative positions of the centralizers.

Another exemplary embodiment relates to a CSN device utilizing a bending beam sensor, which can utilize multiple sets of strain gauges to compensate for possible shear forces induced in the said bending beam.

Another exemplary embodiment relates to a compensator for zero drift of detectors measuring orientation of the sensor string and detectors measuring relative displacement of the centralizers by inducing rotation in the sensor string or taking advantage of rotation of a drill string. If the detector measuring orientation of the sensor string is an accelerometer, such a device can calculate the zero drift of the accelerometer detector by enforcing that the average of the detector-measured value of local Earth's gravity to be equal to the known value of g at a given time, and/or where the zero drift of detectors measuring relative displacement of the centralizers is compensated for by enforcing that the readings of the strain gauges follow the same angular dependence on the rotation of the string as the angular dependence measured by inclinometers, accelerometers, and or gyroscopes placed on the drill string or sensor string that measure orientation of the sensor string with respect to the Earth's gravity.

Another exemplary embodiment relates to a device using buoyancy to compensate for the gravity induced sag of the metrology beam of the proximity-detector-based or angular-metrology-based displacement sensor string.

Another exemplary embodiment relates to centralizers that maintain constant separation between their points of contact with the borehole.

These exemplary embodiments and other features of the invention can be better understood based on the following detailed description with reference to the accompanying drawings.

BRIEF DESCRIPTION OF THE DRAWINGS

FIG. 5*b* shows an expanded view of the encircled local coordinate system shown in FIG. 5*a*.

FIG. 6 is a block diagram showing how navigation and/or surveying can be performed by a CSN system/device in accordance with the invention.

FIG. 7*b* shows the device of FIG. 7*a* through cross section A-A.

DETAILED DESCRIPTION OF PREFERRED EMBODIMENTS

The invention relates to a Centralizer-based Survey and Navigation (hereinafter "CSN") device, system, and methods, designed to provide passageway and down-hole position information. The CSN device can be scaled for use in passageways and holes of almost any size and is suitable for survey of or navigation in drilled holes, piping, plumbing, municipal systems, and virtually any other hole environment. Herein, the terms passageway and borehole are used interchangeably.

Figure 1:
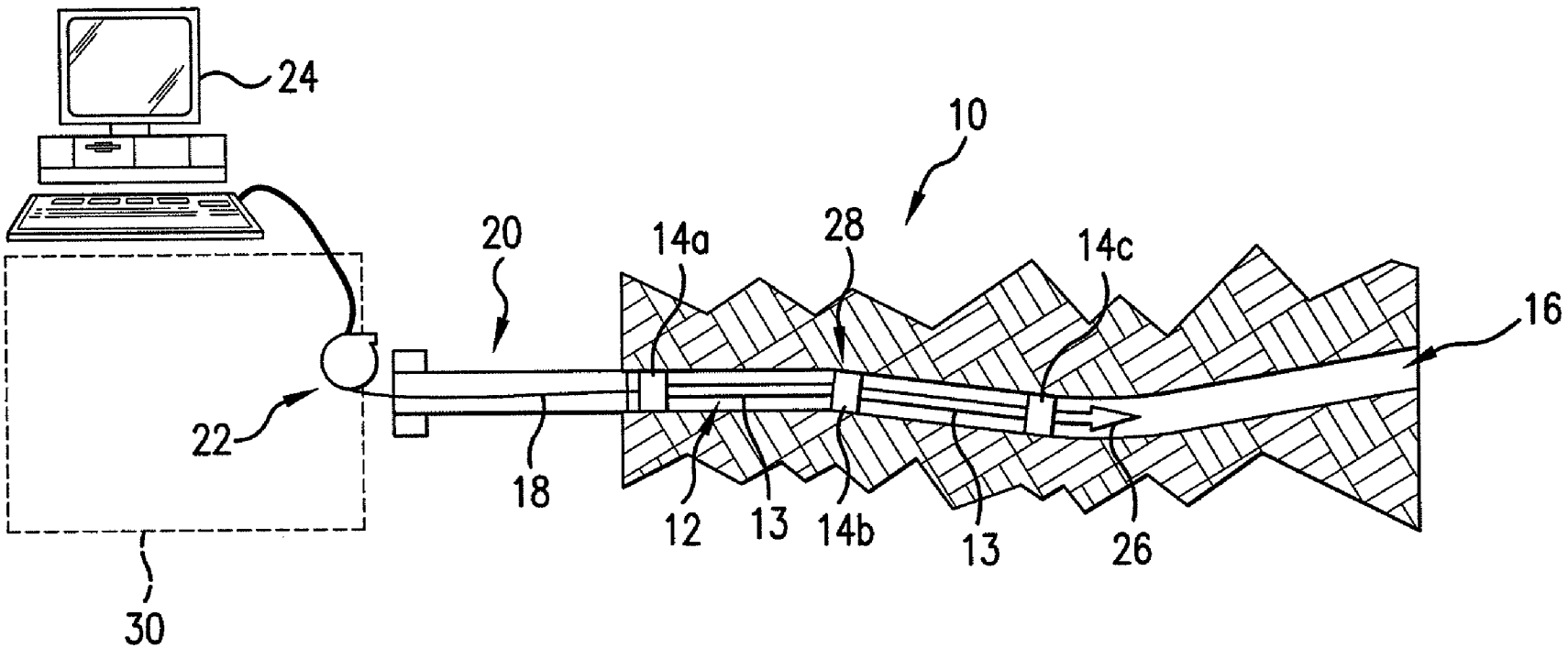
FIG. 1 shows a system incorporating a CSN device in accordance with the invention.

FIG. 1 shows the basic elements of a directional drilling system incorporating a CSN device 10, a sensor string 12 including segments 13 and centralizers 14 (14*a*, 14*b*, and 14*c*), a drill string 18, an initializer 20, an odometer 22, a computer 24, and a drill head 26. A metrology sensor 28 is included and can be associated with the middle centralizer 14*b*, or located on the drill string 18. The odometer 22 and computer 24 hosting a navigation algorithm are, typically, installed on a drill rig 30 and in communication with the CSN device 10. A CSN device 10 may be pre-assembled before insertion into the borehole 16 or may be assembled as the CSN device 10 advances into the borehole 16.

Figure 19:
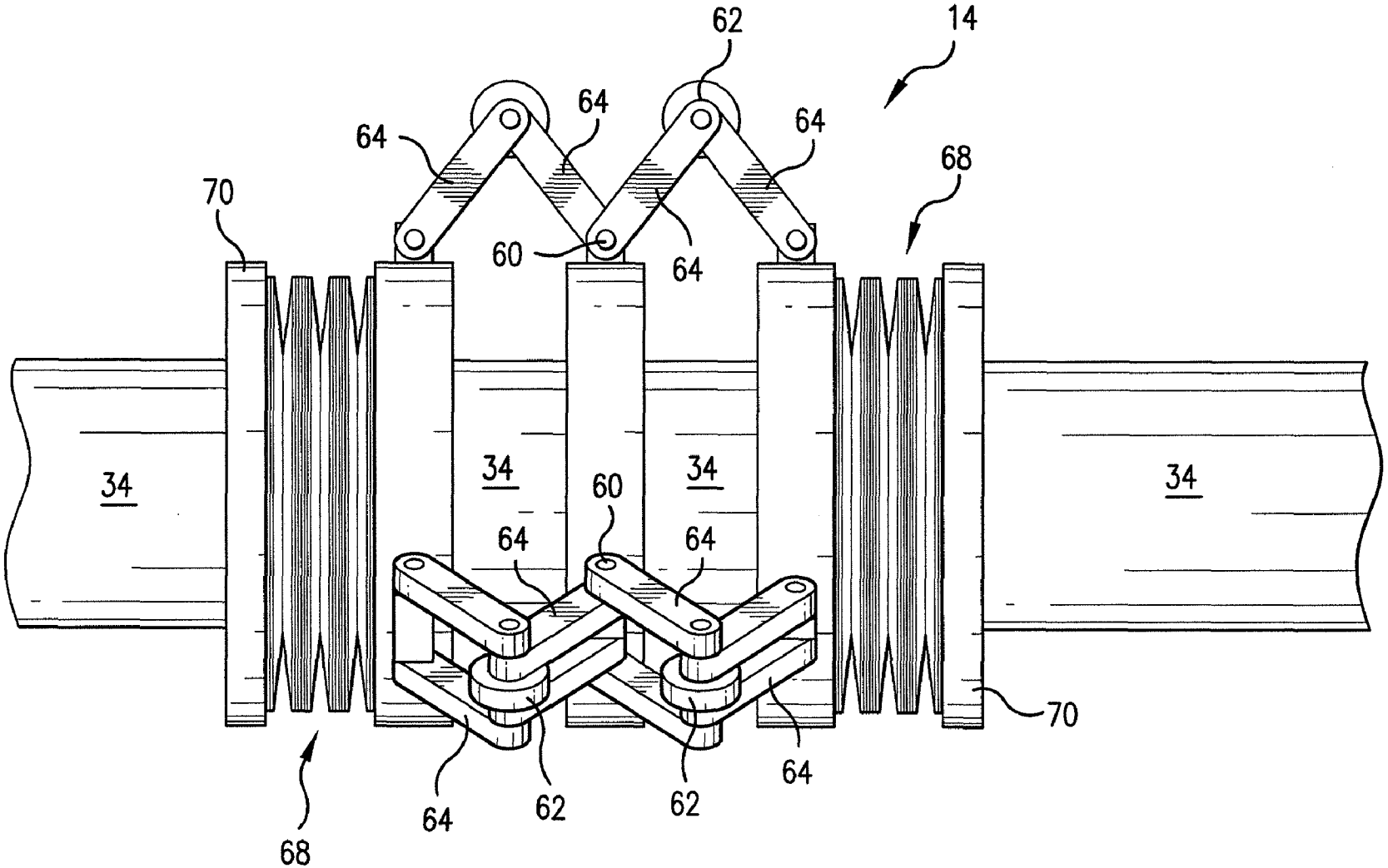
FIGS. 19, 20*a*, and 20*b* show embodiments of centralizers in accordance with the invention.

As shown in FIG. 1, the CSN device 10 can be placed onto a drill string 18 and advanced into the borehole 16. The centralizers 14 of the CSN device 10, which are shown and discussed in greater detail below in relation to FIGS. 19-20*b*, are mechanical or electromechanical devices that position themselves in a repeatable fashion in the center of the borehole 16 cross-section, regardless of hole wall irregularities. A CSN device 10, as shown in FIG. 1, uses at least three centralizers 14: a trailing centralizer 14*a*, a middle centralizer 14*b*, and a leading centralizer 14*c*, so named based on direction of travel within the borehole 16. The centralizers 14 are connected by along a sensor string 12 in one or more segments 13, which connect any two centralizers 14, to maintain a known, constant spacing in the borehole 16 and between the connected centralizers 14. Direction changes of the CSN device 10 evidenced by changes in orientation of the centralizers 14 with respect to each other or with respect to the sensor string 12 segments 13 can be used to determine the geometry of borehole 16.

The initializer 20, shown in FIG. 1, provides information on the borehole 16 and CSN device 10 insertion orientation with respect to the borehole 16 so that future calculations on location can be based on the initial insertion location. The initializer 20 has a length that is longer than the distance between a pair of adjacent centralizers 14 on the sensor string segment 13, providing a known path of travel into the borehole 16 for the CSN device 10 so that it may be initially oriented. Under some circumstances, information about location of as few as two points along the borehole 16 entranceway may be used in lieu of the initializer 20. Navigation in accordance with an exemplary embodiment of the invention provides the position location of the CSN device 10 with respect to its starting position and orientation based on data obtained by using the initializer 20.

As shown in FIGS. 2*a*-2*e*, there are various types of centralizer-based metrologies compatible with the CSN device 10; however, all can determine the position of the CSN device 10 based on readings at the CSN device 10. The types of CSN device 10 metrologies include, but are not limited to: (1) straight beam/angle metrology, shown in FIG. 2*a*; (2) straight beam/displacement metrology, shown in FIG. 2*b*; (3) bending beam metrology, shown in FIG. 2*c*; (4) optical beam displacement metrology, shown in FIG. 2*d*; and (5) combination systems of (1)-(4), shown in FIG. 2*e*. These various metrology types all measure curvatures of a borehole 16 in the vertical plane and in an orthogonal plane. The vertical plane is defined by the vector perpendicular to the axis of the borehole 16 at a given borehole 16 location and the local vertical. The orthogonal plane is orthogonal to the vertical plane and is parallel to the borehole 16 axis. The CSN device 10 uses this borehole 16 curvature information along with distance traveled along the borehole 16 to determine its location in three dimensions. Distance traveled within the borehole 16 from the entry point to a current CSN device 10 location can be measured with an odometer 22 connected either to the drill string 18 used to advance the CSN device 10 or connected with the CSN device 10 itself. The CSN device 10 can be in communication with a computer 24, which can be used to calculate location based on the CSN device 10 measurements and the odometer 22. Alternatively, the CSN device 10 itself can include all instrumentation and processing capability to determine its location and the connected computer 24 can be used to display this information.

Definitions of starting position location and starting orientation (inclination and azimuth), from a defined local coordinate system (FIG. 5*b*) provided by the initializer 20, allows an operator of the CSN device 10 to relate drill navigation to known surface and subsurface features in a Global coordinate system. A navigation algorithm, such as that shown in FIG. 6, can combine the readings of the sensor string segment(s) 12, the odometry sensor(s) 22, and the initializer 20 to calculate the borehole 16 position of the CSN device 10.

Figure 5A:
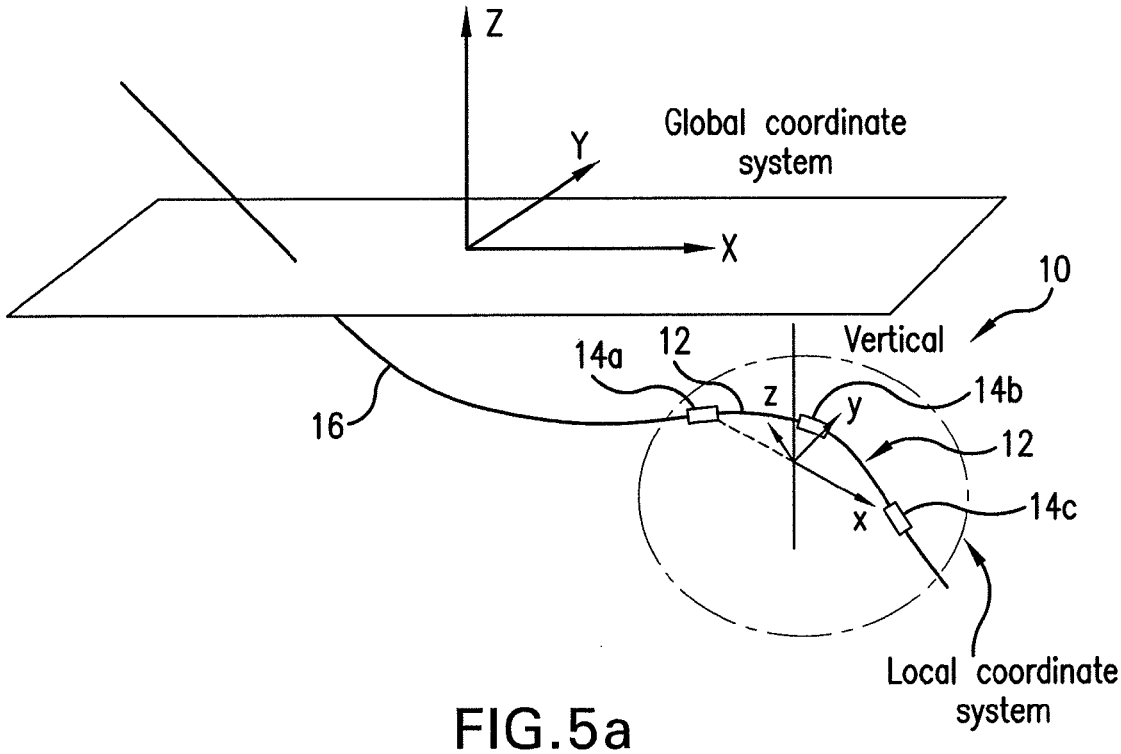
FIGS. 5*a* through 5*d* show a global and local coordinate system utilized by a CSN device, in accordance with the invention.
Figure 5B:
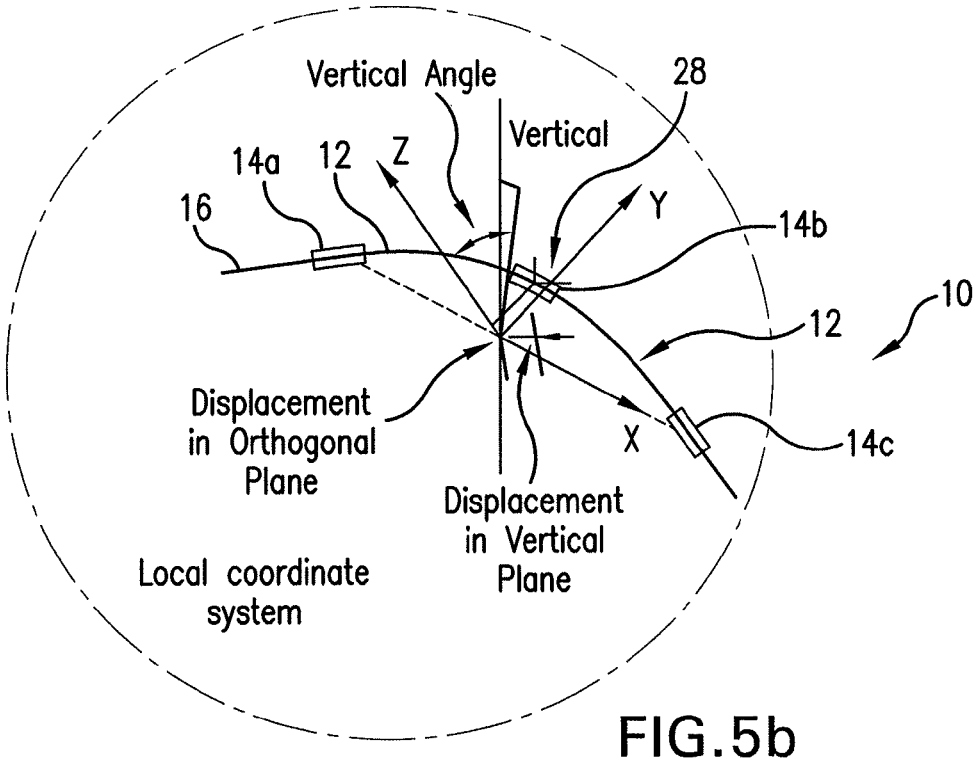

A CSN device 10 provides the relative positions of the centralizers 14. More precisely, an ideal three-centralizer CSN device 10 provides vector coordinates of the leading centralizer 14*c* in a local coordinate system, as shown by FIG. 5*b*, where the "x" axis is defined by the line connecting the centralizers 14*a* and 14*c* and the "z" axis lies in a plane defined by the "x" axis and the global vertical "Z." Alternately, the position of the middle centralizer would be provided in a coordinate system where the "x" axis is defined by the line connecting the centralizers 14*a* and 14*b* and the "y" axis and "z" axis are defined same as above. Coordinate systems where the x axis connects either leading and trailing centralizers, or leading and middle centralizer, or middle and trailing centralizers, while different in minor details, all lead to mathematically equivalent navigation algorithms and will be used interchangeably.

Figure 2A:
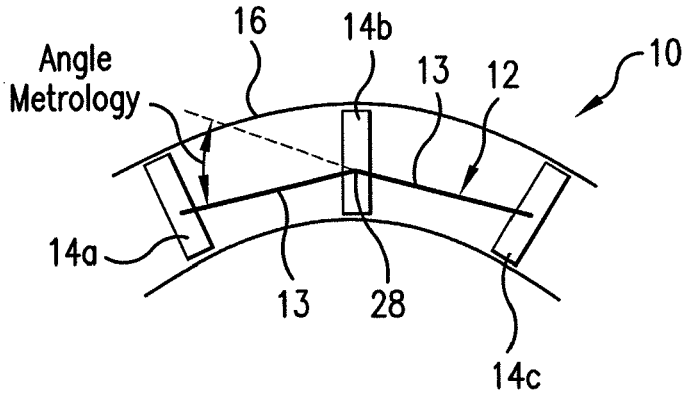
FIG. 2*a* through FIG. 2*e* show various embodiments of a CSN device in accordance with the invention.
Figure 3:
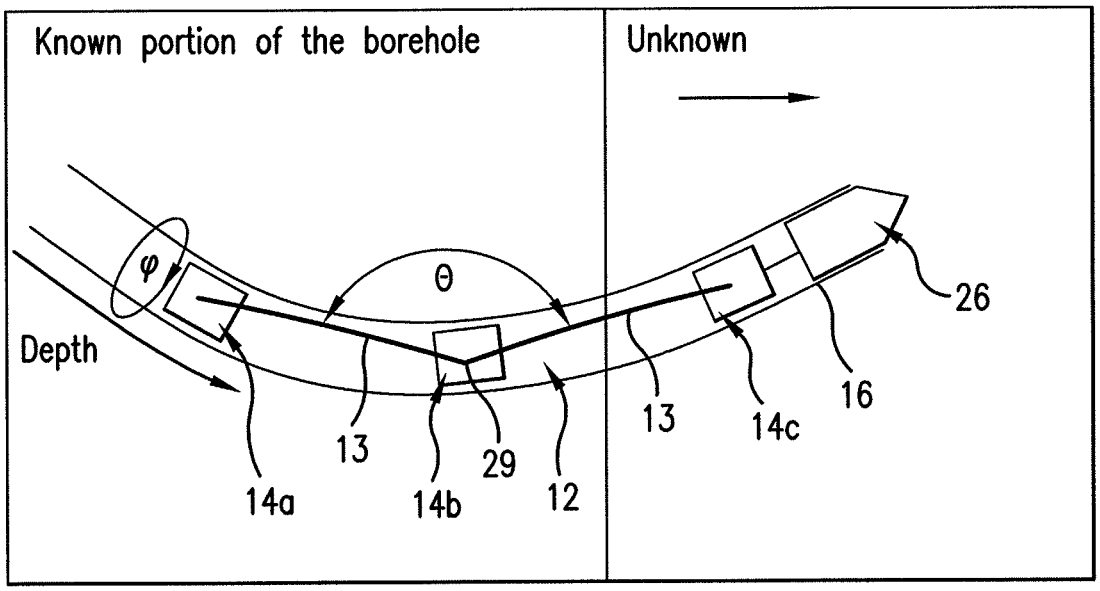
FIG. 3 shows a system incorporating a CSN device as shown in FIG. 2*a*, in accordance with the invention.

FIG. 3 illustrates a CSN device 10 in accordance with the metrology technique shown in FIG. 2*a*, where angle of direction change between the leading centralizer 14*c* and trailing centralizer 14*a* is measured at the middle centralizer 14*b*. As shown, the CSN device 10 follows the drill head 26 through the borehole 16 as it changes direction. The magnitude of displacement of the centralizers 14 with respect to each other is reflected by an angle $\theta$ between the beam forming segment 13 connecting the centralizers 14*c* and 14*b* and the beam forming segment 13 connecting the centralizers 14*b* and 14*a*, which is measured by angle-sensing detector(s) 29 (a metrology sensor 28) at or near the middle centralizer 14*b*. Rotation $\phi$ of the sensor string 12 can also be measured.

Figure 2B:
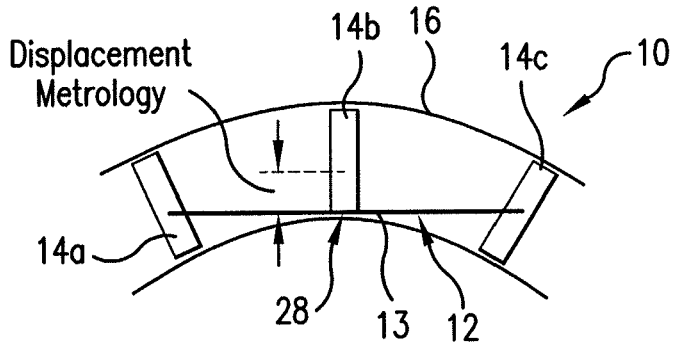
Figure 2C:
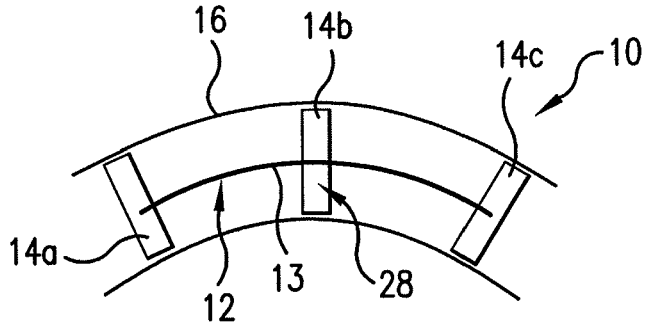
Figure 2D:
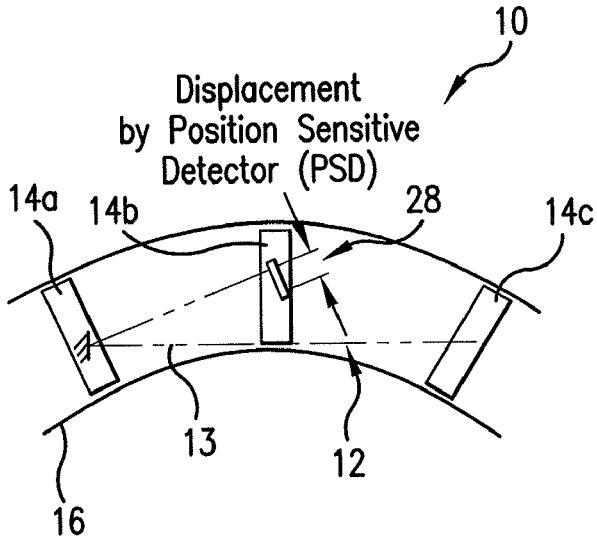
Figure 2E:
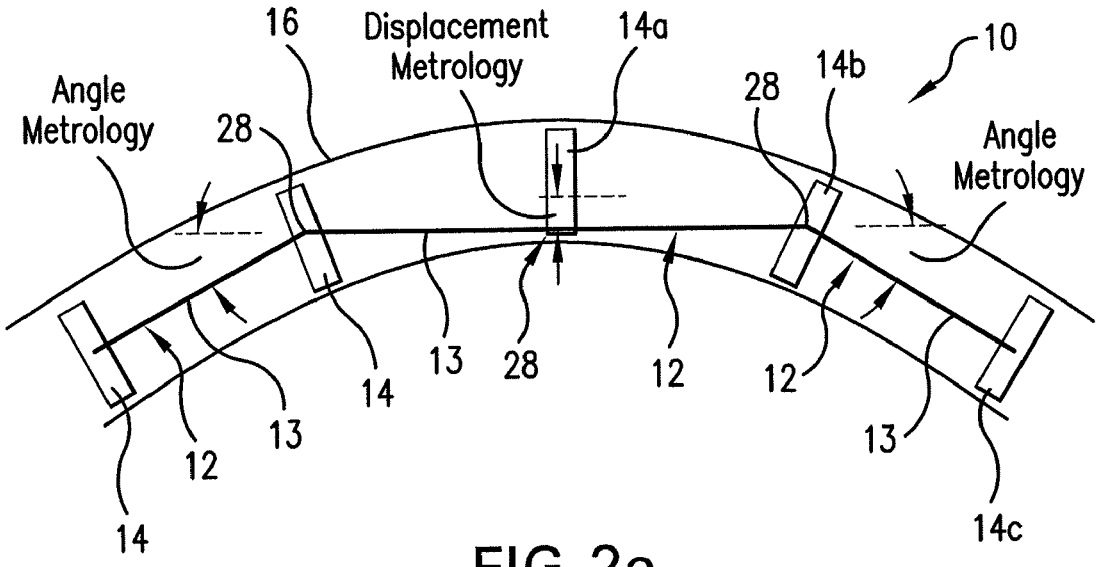
Figure 4:
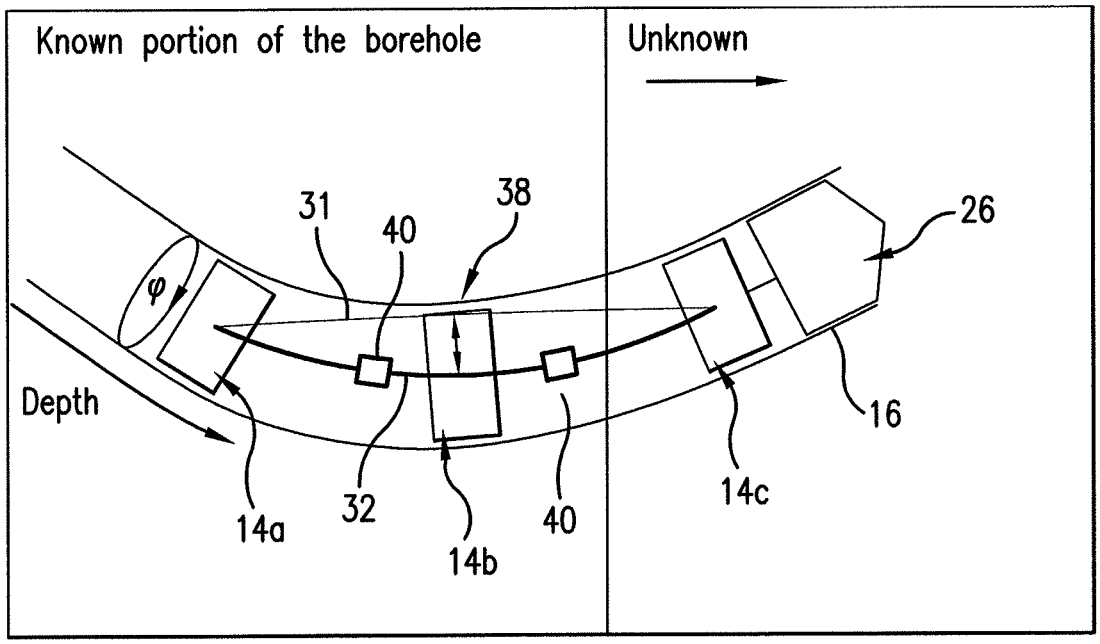
FIG. 4 illustrates a CSN device utilizing a displacement or strain metrology as shown in FIGS. 2*b*, 2*c*, and 2*e*, in accordance with the invention.

FIG. 4 shows a CSN device 10 configured for an alternative navigation/survey technique reflecting the metrology techniques shown in FIGS. 2*b*, 2*c*, and 2*e*, i.e., both displacement and bending/strain metrology. Displacement metrology (discussed in greater detail below in relation to FIGS. 7*a* and 7*b*) measures relative positions of the centralizers 14 using a straight displacement metrology beam 31 (as a sensor string 12 segment 13) that is mounted on the leading and trailing centralizers, 14*c* and 14*a*. Proximity detectors 38 (a metrology sensor 28) measure the position of the middle centralizer 14*b* with respect to the straight metrology beam 31.

Still referring to FIG. 4, strain detector metrology (discussed further below in relation to FIGS. 8-12) can also be used in the CSN device 10, which is configured to measure the strain induced in a solid metrology beam 32 (another form of sensor string segment 12) that connects between each of the centralizers 14. Any deviation of the centralizer 14 positions from a straight line will introduce strains in the beam 32. The strain detectors or gauges 40 (a type of metrology sensor 28) measure these strains (the terms strain detectors and strain gauges are used interchangeably herein). The strain gages 40 are designed to convert mechanical motion into an electronic signal. The CSN device 10 can have as few as two strain gauge instrumented intervals in the beam 32. Rotation $\phi$ of the sensor string 12 can also be measured.

In another implementation, both strain detectors 40 and proximity detectors 38 may be used simultaneously to improve navigation accuracy. In another implementation, indicated in FIG. 2*d*, the displacement metrology is based on a deviation of the beam of light such as a laser beam. In a three centralizer 14 arrangement, a coherent, linear light source (e.g., laser) can be mounted on the leading centralizer 14*c* to illuminate the trailing centralizer 14*a*. A reflecting surface mounted on trailing centralizer 14*a* reflects the coherent light back to a position sensitive optical detector (PSD, a metrology sensor 28) mounted on middle centralizer 14*b*, which converts the reflected location of the coherent light into an electronic signal. The point at which the beam intersects the PSD metrology sensor 28 is related to the relative displacement of the three centralizers 14. In a two centralizer 14 optical metrology sensor arrangement, light from a laser mounted on a middle centralizer 14*b* is reflected from a mirror mounted on an adjacent centralizer 14 and redirected back to a PSD metrology sensor 28 mounted on the middle centralizer 14*b*. The point at which the beam intersects the PSD metrology sensor 28 is related to the relative angle of the orientation of the centralizers 14.

As mentioned above, a CSN navigation algorithm (FIG. 6) uses a local coordinate system (x, y, z) to determine the location of a CSN device 10 in three dimensions relative to a Global coordinate system (X, Y, Z). FIG. 5*a* indicates the general relationship between the two coordinate systems where the local coordinates are based at a location of CSN device 10 along borehole 16 beneath the ground surface. A CSN navigation algorithm can be based on the following operation of the CSN device 10: (1) the CSN device 10 is positioned in such a way that the trailing centralizer 14*a* and the middle centralizer 14*b* are located in a surveyed portion (the known part) of the borehole 16 and the leading centralizer 14*c* is within an unknown part of the borehole 16; (2) using displacement metrology, a CSN device 10 comprises a set of detectors, e.g., metrology sensor 28, that calculates the relative displacement of the centralizers 14 with respect to each other in the local coordinate system; (3) a local coordinate system is defined based on the vector connecting centralizers 14 *a* and 14*c* (axis "x" in FIG. 5*b*) and the direction of the force of gravity (vertical or "Z" in FIG. 5*b*) as measured by, e.g., vertical angle detectors, as a metrology sensor 28; and (4) prior determination of the positions of the middle and trailing centralizers 14*b* and 14*a*. With this information in hand, the position of the leading centralizer 14*c* can be determined.

Figure 5C:
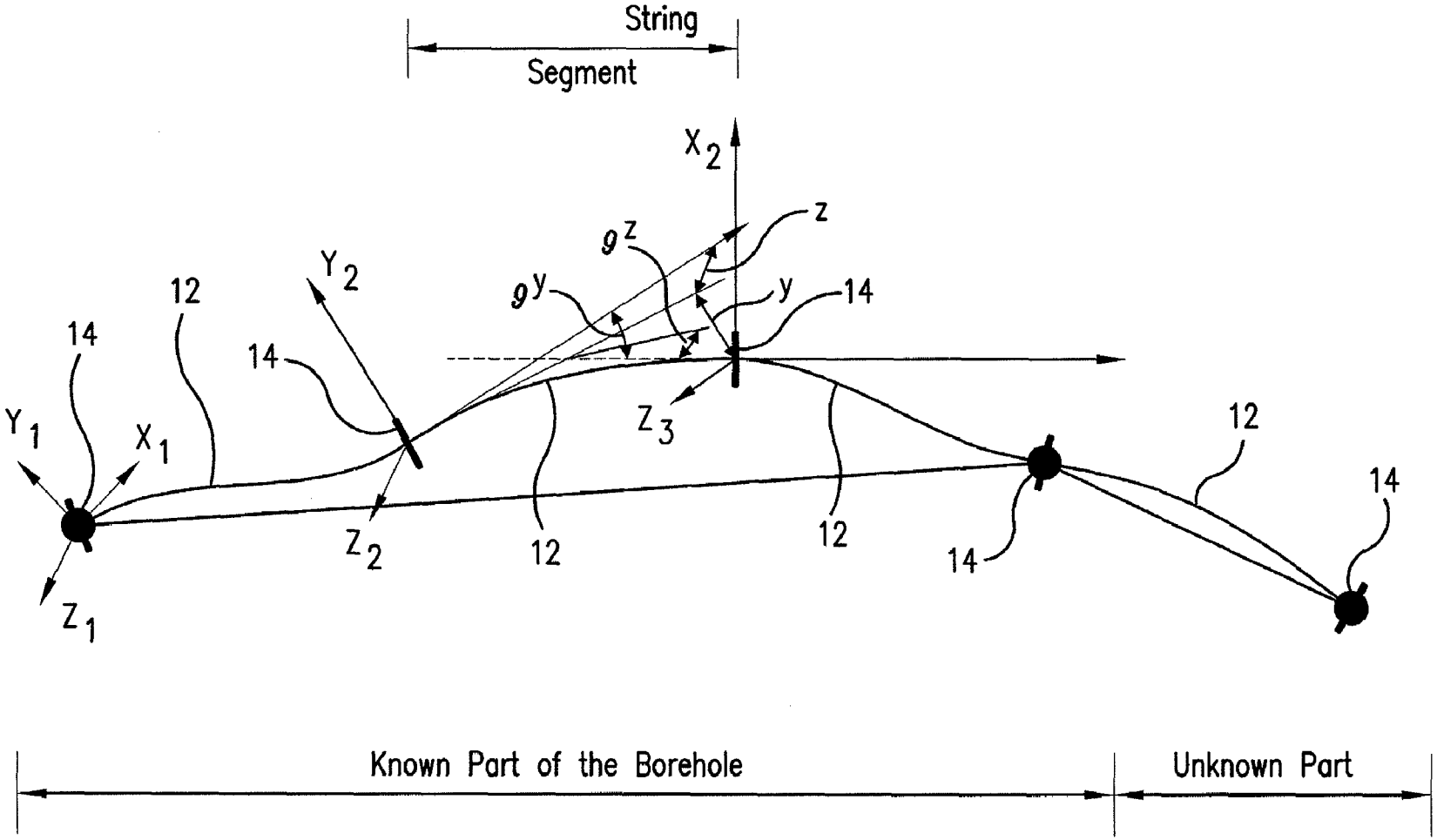
Figure 5D:
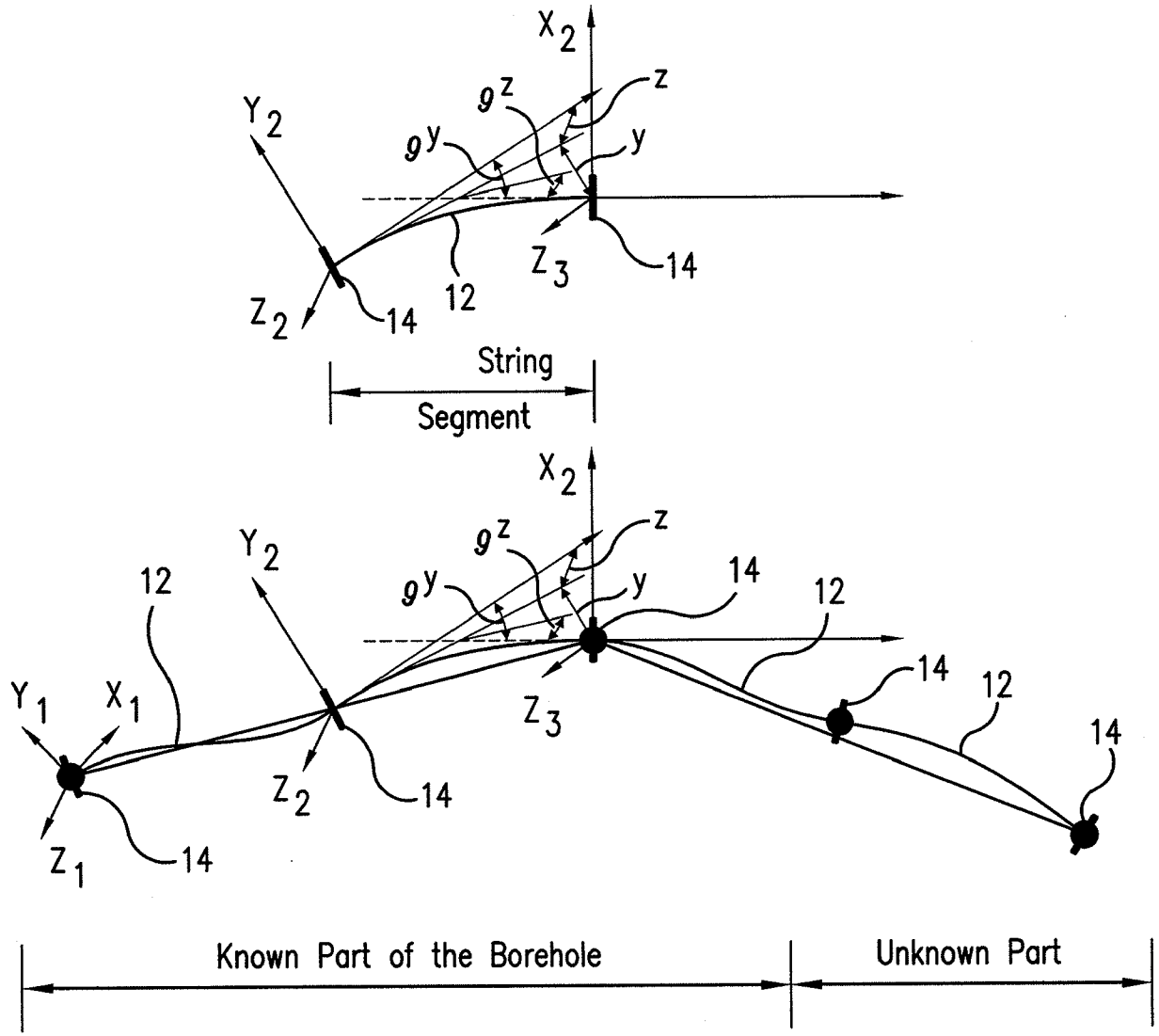

An algorithm as shown in FIG. 6 applied by, e.g., a processor, and functioning in accordance with the geometry of FIG. 5*c* can perform as follows: (1) the CSN device 10 is positioned as indicated in the preceding paragraph; (2) the relative angular orientations $\Theta^y$, $\Theta^z$ and positions (y, z) of any two adjacent sensor string segments 13 of a CSN device 10 in the local coordinate system are determined using internal CSN device 10 segment 13 detectors; (3) three centralizers 14 are designated to be the leading 14*c*, trailing 14*a*, and middle 14*b* centralizers of the equivalent or ideal three-centralizer CSN device 10; (4) relative positions of the leading, middle, and trailing centralizers 14 forming an ideal CSN device 10 are determined in the local coordinate system of the sensor string 12.

Figure 7A:
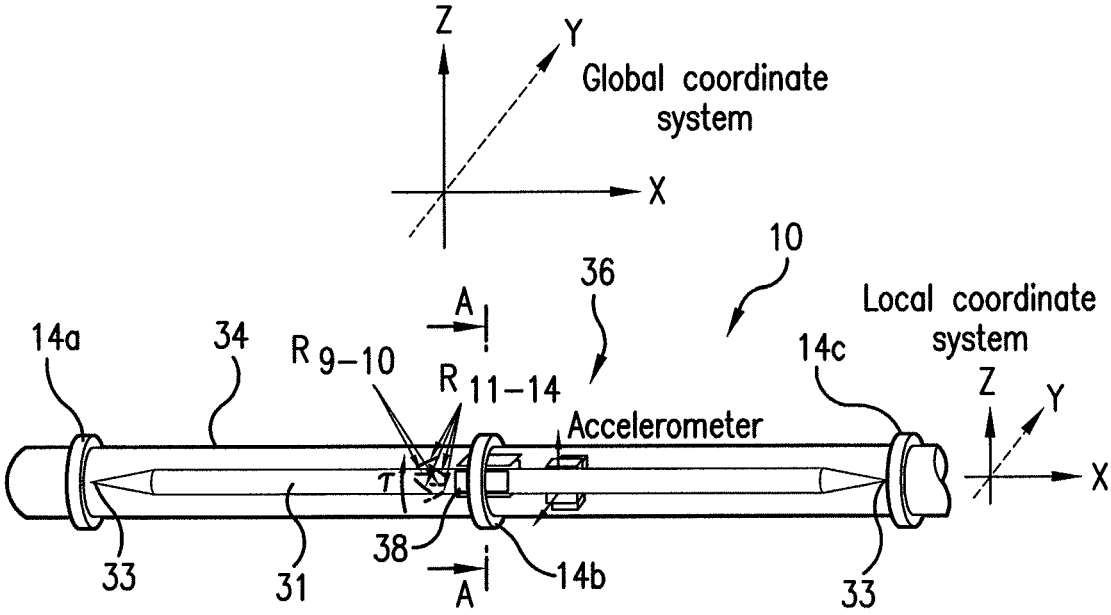
FIGS. 7*a* and 7*b* show a displacement metrology CSN device, in accordance with the invention.

FIG. 7*a* shows a CSN device 10 according to an alternative exemplary embodiment of the invention that utilizes straight beam displacement (such as shown in FIGS. 2*b* and 4) and capacitance measurements as metrology sensors 28 to calculate the respective locations of the centralizers 14*a*, 14*b*, and 14*c*. As shown in FIG. 7*a*, a stiff straight beam 31 is attached to the leading and trailing centralizers 14*c* and 14*a* by means of flexures 33 that are stiff in radial direction and flexible about the axial direction (τ). A set of proximity detectors, 38 can be associated with the middle centralizer 14*b*. The proximity detectors 38 measure the displacement of the middle centralizer 14*b* with respect to the straight beam 31. An accelerometer 36 can be used to measure the orientation of the middle centralizer 14*b* with respect to the vertical. Examples of proximity detectors include, capacitance, eddy current, magnetic, strain gauge, and optical proximity detectors. The Global and Local coordinate systems (FIGS. 5*a*-5*d*) associated with the CSN device 10 of this embodiment are shown in FIG. 7*a*.

Figure 7B:
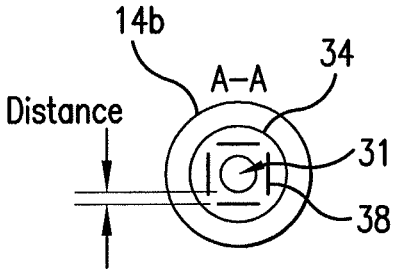

The relationship between these proximity detectors 38 and the straight beam 31 is shown in FIG. 7*b* as a cross-sectional view of the CSN device 10 of FIG. 7*a* taken through the center of middle centralizer 14*b*. The proximity detectors 38 measure position of the middle centralizer 14*b* in the local coordinate system as defined by the vectors connecting leading and trailing centralizers 14*a* and 14*c* and the vertical. The CSN device 10 as shown in FIGS. 7*a* and 7*b* can have an electronics package, which can include data acquisition circuitry supporting all detectors, including proximity detectors 38, strain gauges 40 (FIG. 8), inclinometers (e.g., the accelerometer 36), etc., and power and communication elements (not shown).

Data reduction can be achieved in a straight beam displacement CSN device 10, as shown in FIG. 7*a*, as explained below. The explanatory example uses straight beam displacement metrology, capacitance proximity detectors 38, and accelerometer 36 as examples of detectors. The displacements of the middle centralizer 14*b* in the local coordinate system (x, y, z) defined by the leading and trailing centralizers 14*c* and 14*a* are:

$$d_{horizontal}=d_z\cos\phi+d_y\sin\phi$$

$$d_{vertical}=-d_z\sin\phi+d_y\cos\phi \qquad \text{(Eq. 1)}$$

Where $d_{horizontal}$ and $d_{vertical}$ are displacements in the vertical and orthogonal planes defined earlier, $d_z$ and $d_y$ are the displacements measured by the capacitance detectors 38, and as indicated in FIG. 4, φ is the angle of rotation of the capacitance detectors 38 with respect to the vertical as determined by the accelerometer(s) 36. Thus, the centralizer 14 coordinates in the local (x, y, z) coordinate system are:

$$\vec{u}_1=\begin{bmatrix}0\\0\\0\end{bmatrix} \qquad \text{(Eq. 2)}$$

$$\vec{u}_2=\begin{bmatrix}\sqrt{L_1-d_{horizontal}^2-d_{vertical}^2}\\ d_{horizontal}\\ d_{vertical}\end{bmatrix}$$

$$\vec{u}_3=\begin{bmatrix}\sqrt{L_1^2-d_{horizontal}^2-d_{vertical}^2}+\sqrt{L_2^2-d_{horizontal}^2-d_{vertical}^2}\\ 0\\ 0\end{bmatrix}$$

where $u_i$ are position of the leading (i=3), trailing (i=1) and middle (i=2) centralizers 14*c*, 14*b*, and 14*a*, respectively, and; $L_1$ and $L_2$ are the distances between the leading and middle 14*c* and 14*b* and middle and trailing centralizers 14*b* and 14*a*.

The direction of vector $u_2$ is known in the global coordinate system (X, Y, Z) since the trailing and middle centralizers are located in the known part of the borehole. Therefore, the orientations of axes x, y, and z of the local coordinate system, in the global coordinate system (X, Y, Z) are:

$$\vec{x}=\frac{\vec{u}_2}{|\vec{u}_2|} \qquad \text{(Eq. 3)}$$

$$\vec{z}=\frac{\vec{g}-\vec{g}\cdot\vec{x}}{|\vec{g}-\vec{g}\cdot\vec{x}|}$$

$$\vec{y}=\vec{z}\otimes\vec{x}$$

$$\text{where } \vec{g}=\begin{bmatrix}0\\0\\1\end{bmatrix}$$

The displacement of the leading centralizer 14*c* (FIG. 5*b*) in the coordinate system as determined by the middle and trailing centralizers 14*b* and 14*a* (respectively, FIG. 5*b*) can be written as:

$$\bar{u}_x=\bar{x}\cdot(\bar{u}_3-\bar{u}_2)$$

$$\bar{u}_y=\bar{y}\cdot(\bar{u}_3-\bar{u}_2)$$

$$\bar{u}_s=\bar{z}\cdot(\bar{u}_3-\bar{u}_2) \quad \text{(Eq. 4)}$$

Calculating $u_3$ in the global coordinate system provides one with the information of the position of the leading centralizer 14*c* and expands the knowledge of the surveyed borehole 16.

Figure 8:
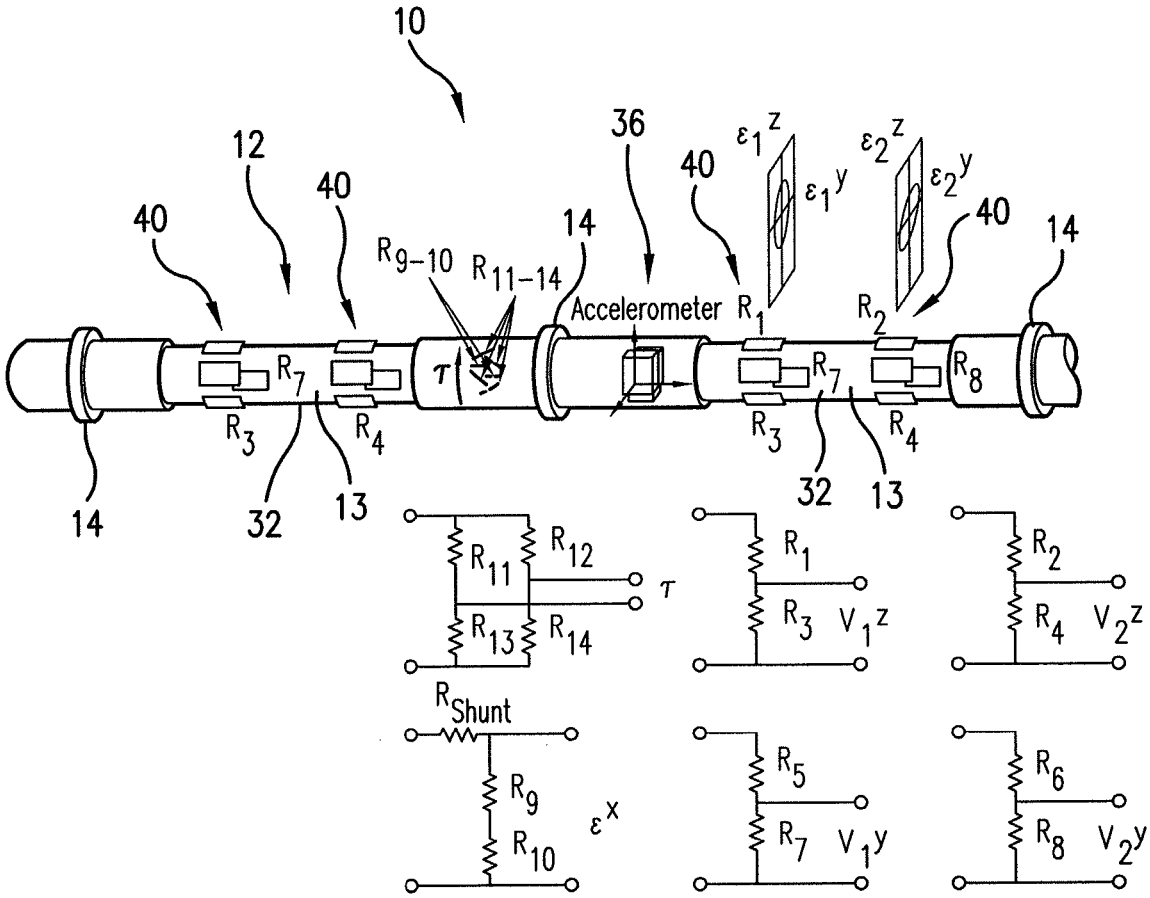
FIG. 8 shows a CSN device utilizing strain gauge metrology sensors in accordance with the invention.

As discussed above, an alternative to the straight beam displacement CSN device 10 is the bending beam CSN device 10, as shown in FIG. 2*c* and FIG. 4. FIG. 8 shows a CSN device 10 with strain gauge detectors 40 attached to a bending beam 32. The circuit design associated with the resistance strain gauges 40 and accelerometer(s) 36 is shown below the CSN device 10. Any type of strain detector 40 and orientation detector, e.g., accelerometer 36, may be used. Each instrumented sensor string 12 segment 13, here the bending beam 32 (between centralizers 14) of the CSN device 10 can carry up to four, or more, sets of paired strain gauge detectors 40 (on opposite sides of the bending beam 32), each opposing pair forming a half-bridge. These segments 13 may or may not be the same segments 13 that accommodate the capacitance detector 38 if the CSN device 10 utilizes such. In the device 10 shown in FIG. 8, strain gauge detector 40 and accelerometer 36 readings can be recorded simultaneously. A displacement detector supporting odometry correction (Δl) can also be placed on at least one segment 13 (not shown). Several temperature detectors (not shown) can also be placed on each segment 13 to permit compensation for thermal effects.

It is preferred that, in this embodiment, four half-bridges (strain detector 40 pairs) be mounted onto each sensor string segment 13 (between centralizers 14) as the minimum number of strain detectors 40 . The circuit diagrams shown below the CSN device 10, with voltage outputs $V^z_1$, $V^y_1$, $V^z_2$, and $V^y_2$, represent an exemplary wiring of these half-bridges. These detectors 40 can provide the relative orientation and relative position of the leading centralizer 14*c* with respect to the trailing centralizer 14*a*, or a total of four variables. It is also preferred that at least one of the adjacent sensor string segments 13 between centralizers 14 should contain a detector (not shown) that can detect relative motion of the CSN device 10 with respect to the borehole 16 to determine the actual borehole 16 length when the CSN device 10 and drill string 18 are advanced therein.

Shear forces act on the CSN device 10 consistent with the expected shape shown in FIG. 8 where each subsequent segment 12 can have slightly different curvature (see chart below and corresponding to the CSN device 10). The variation of curvatures of the beam 32 likely cannot be achieved without some shear forces applied to centralizers 14. The preferred strain gauge detector 40 scheme of the CSN device 10 shown in FIG. 8 accounts for these shear forces. The exemplary circuit layout shown below the CSN device 10 and corresponding chart shows how the sensors 40 can be connected.

Figure 9:
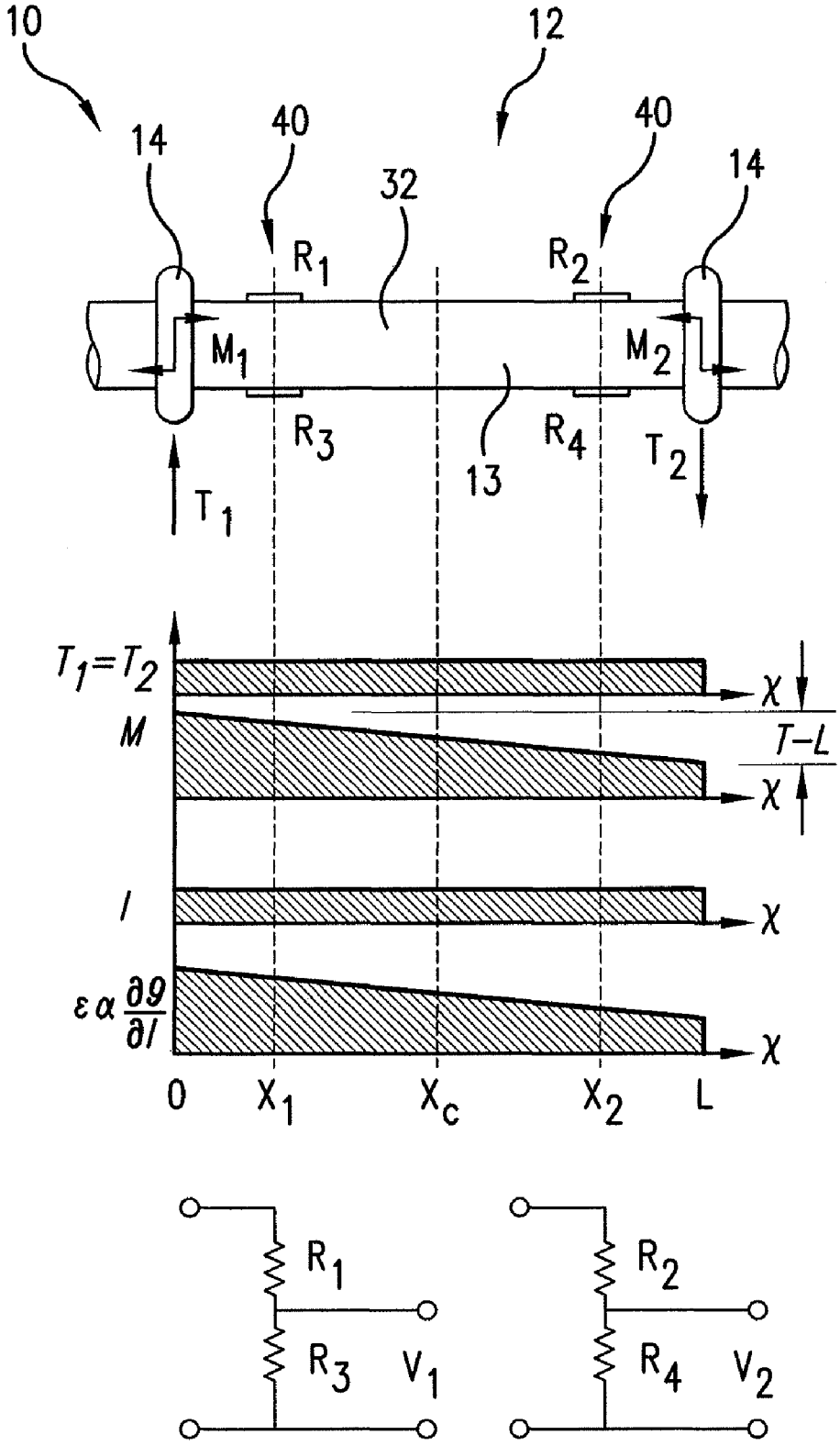
FIG. 9 shows forces acting on a CSN device as shown in FIG. 8, in accordance with the invention.

FIG. 9 illustrates two dimensional resultant shear forces acting on centralizers 14 of a single sensor string segment 13 comprised of a bending bean 32 as shown in FIG. 8. Four unknown variables, namely, two forces and two bending moments, should satisfy two equations of equilibrium: the total force and the total moment acting on the bending beam 32 are equal to zero. FIG. 9 shows the distribution of shear force ($\overline{T}$) and moments ($\overline{M}$) along the length of bending beam 32. The values are related in the following bending equation:

$$\frac{\partial\vartheta}{dx}=\frac{M}{E\cdot I} \quad \text{(Eq. 5)}$$

$$\vec{M}=\vec{M}_1+\frac{\vec{M}_2-\vec{M}_1}{L}\cdot x$$

Where Θ is the angle between the orientation of the beam 32 and the horizontal, E is the Young Modulus of the beam 32 material, I is the moment of inertia, and L is the length of the segment 12 as determined by the locations of centralizers 14.

According to FIG. 9, in a small angle approximation, the orientation of the points along the axis of the segment 12 in each of two directions (y, z) perpendicular to the axis of the beam (x) may be described such that the relative angular orientation of the end points of the segment 12 with respect to each other can be represented by integrating over the length of the segment:

$$\vartheta=\int_0^x\frac{M}{E\cdot I}dx=M_1\cdot\int_0^x\frac{dx}{E\cdot I}+(M_2-M_1)\cdot\int_0^x\frac{x\,dx}{E\cdot I\cdot L} \quad \text{(Eq. 6)}$$

or, $$\vartheta=M_1\cdot\int_0^L\frac{(L-x)\cdot dx}{E\cdot I\cdot L}+M_2\cdot\int_0^L\frac{x\cdot dx}{E\cdot I\cdot L} \quad \text{(Eq. 7)}$$

The values of the integrals are independent of the values of the applied moments and both integrals are positive numbers. Thus, these equations (Eqs. 6 and 7) can be combined and rewritten as:

$$\Theta=M_1\cdot\mathrm{Int}_1^{\Theta}+M_2\cdot\mathrm{Int}_2^{\Theta} \quad \text{(Eq. 8)}$$

where $\mathrm{Int}_1^{\Theta}$ and $\mathrm{Int}_2^{\Theta}$ are calibration constants for a given sensor string segment 12 such as that shown in FIG. 9).

If two sets of strain gauges 40 ($R_1$, $R_2$ and $R_3$, $R_4$) are placed on the beam 32 (see FIG. 9) at positions $x_1$ and $x_2$ (see charts below drawings in FIG. 9), the readings of these strain gauges 40 are related to the bending moments applied to CSN device 10 segment as follows:

$$\varepsilon_1=\frac{M(x_1)\cdot d_1}{2\cdot E\cdot I_1}=\frac{d_1}{2\cdot E\cdot I_1}\cdot\left(M_1+(M_2-M_1)\cdot\frac{x_1}{L}\right) \quad \text{(Eq. 9)}$$

$$\varepsilon_2=\frac{M(x_2)\cdot d_2}{2\cdot E\cdot I_2}=\frac{d_2}{2\cdot E\cdot I_2}\cdot\left(M_1+(M_2-M_1)\cdot\frac{x_2}{L}\right)$$

where $I_1$ and $I_2$ are moments of inertia of corresponding cross-section (of beam 32 at strain gauges 40) where half bridges are installed (FIG. 9), and $d_1$ and $d_2$ are beam diameters at corresponding cross-sections.

If the values of the strain gauge outputs are known, the values of the moments (M) can be determined by solving the preceding Eq. 9. The solution will be:

$$M_1=\frac{2}{d_1\cdot d_2}\cdot\frac{E\cdot I_1\cdot\varepsilon_1\cdot x_2\cdot d_2-E\cdot I_2\cdot\varepsilon_2\cdot x_1\cdot d_1}{(L-x_1)\cdot x_2-x_1\cdot(L-x_2)} \quad \text{(Eq. 10)}$$

-continued $$M_2 = \frac{2}{d_1 \cdot d_2} \cdot \frac{-E \cdot I_1 \cdot \varepsilon_1 \cdot (L - x_1) \cdot d_1 + E \cdot I_2 \cdot \varepsilon_2 \cdot (L - x_2) \cdot d_1}{(L - x_1) \cdot x_2 - x_1 \cdot (L - x_2)}$$

which may also be rewritten as:

$$M_1 = m_{1,1} \cdot \epsilon_1 + m_{1,2} \cdot \epsilon_2$$

$$M_2 = m_{2,1} \cdot \epsilon_1 + m_{2,2} \cdot \epsilon_2 \quad \text{(Eq. 11)}$$

where $m_{i,j}$ are calibration constants. Substitution of Eq. 11 into Eq. 8 gives:

$$\Theta = \epsilon_1 \cdot (\mathrm{Int}_1^{\Theta} \cdot m_{1,1} + \mathrm{Int}_2^{\Theta} \cdot m_{2,1}) + \epsilon_2 \cdot (\mathrm{Int}_1^{\Theta} \cdot m_{1,2} + \mathrm{Int}_2^{\Theta} \cdot m_{2,2}) \quad \text{(Eq. 12)}$$

Similarly, vertical displacement of the leading end of the string segment 12 may be written as:

$$y = M_1 \cdot \int_0^L dx \int_0^x \frac{(L-x)}{E \cdot I \cdot L} \cdot dx + M_2 \cdot \int_0^L dx \int_0^x \frac{x}{E \cdot I \cdot L} dx \quad \text{(Eq. 13)}$$

$$y = M_1 \cdot \left( \int_0^L \frac{(L-x) \cdot L}{E \cdot I \cdot L} \cdot dx - \int_0^L \frac{(L-x) \cdot x}{E \cdot I \cdot L} \cdot dx \right) + M_2 \cdot \left( \int_0^L \frac{x \cdot L}{E \cdot I \cdot L} \cdot dx - \int_0^L \frac{x^2}{E \cdot I \cdot L} \cdot dx \right)$$

$$y = M_1 \cdot \int_0^L \frac{(L-x)^2}{E \cdot I \cdot L} \cdot dx + M_2 \cdot \int_0^L \frac{L \cdot x - x^2}{E \cdot I \cdot L} \cdot dx$$

As was the case in relation to Eqs. 6 and 7, both integrals of Eq. 13 are positive numbers independent of the value of applied moment. Thus, Eq. 13 may be rewritten as:

$$y = M_1 \cdot \mathrm{Int}_1^y + M_2 \cdot \mathrm{Int}_2^y \quad \text{(Eq. 14)}$$

and also $$y = \epsilon_1 \cdot (\mathrm{Int}_1^y \cdot m_{1,1} + \mathrm{Int}_2^y \cdot m_{2,1}) + \epsilon_2 \cdot (\mathrm{Int}_1^y \cdot m_{1,2} + \mathrm{Int}_2^y \cdot m_{2,2}) \quad \text{(Eq. 15)}$$

Note that the values of $m_{i,j}$ are the same in both Eq. 12 and Eq. 15. In addition, the values of the Int factors satisfy the following relationship:

$$\mathrm{Int}_1^y + \mathrm{Int}_2^y = L \cdot \mathrm{Int}_1^{\Theta} \quad \text{(Eq. 16)}$$

which may be used to simplify device calibration.

For a bending beam 32 (FIG. 9) with a constant cross-section, the values of the integrals in Eq. 16 are:

$$Int_1^{\theta} = \frac{1}{2} \frac{L}{E \cdot I} \quad \text{(Eq. 17)}$$

$$Int_2^{\theta} = \frac{1}{2} \frac{L}{E \cdot I}$$

$$Int_1^{y} = \frac{1}{3} \frac{L^2}{E \cdot I}$$

$$Int_2^{y} = \frac{1}{6} \frac{L^2}{E \cdot I}$$

The maximum bending radius that a CSN device 10, as shown in FIG. 9, is expected to see is still large enough to guarantee that the value of the bending angle is less than 3 degrees or 0.02 radian. Since the cos(0.02)~0.999, the small angle approximation is valid and Eqs. 6-17 can be used to independently calculate of projections of the displacement of the leading centralizer 14 relative to a trailing centralizer 14 in both "y" and "z" directions of the local coordinate system.

Figure 10:
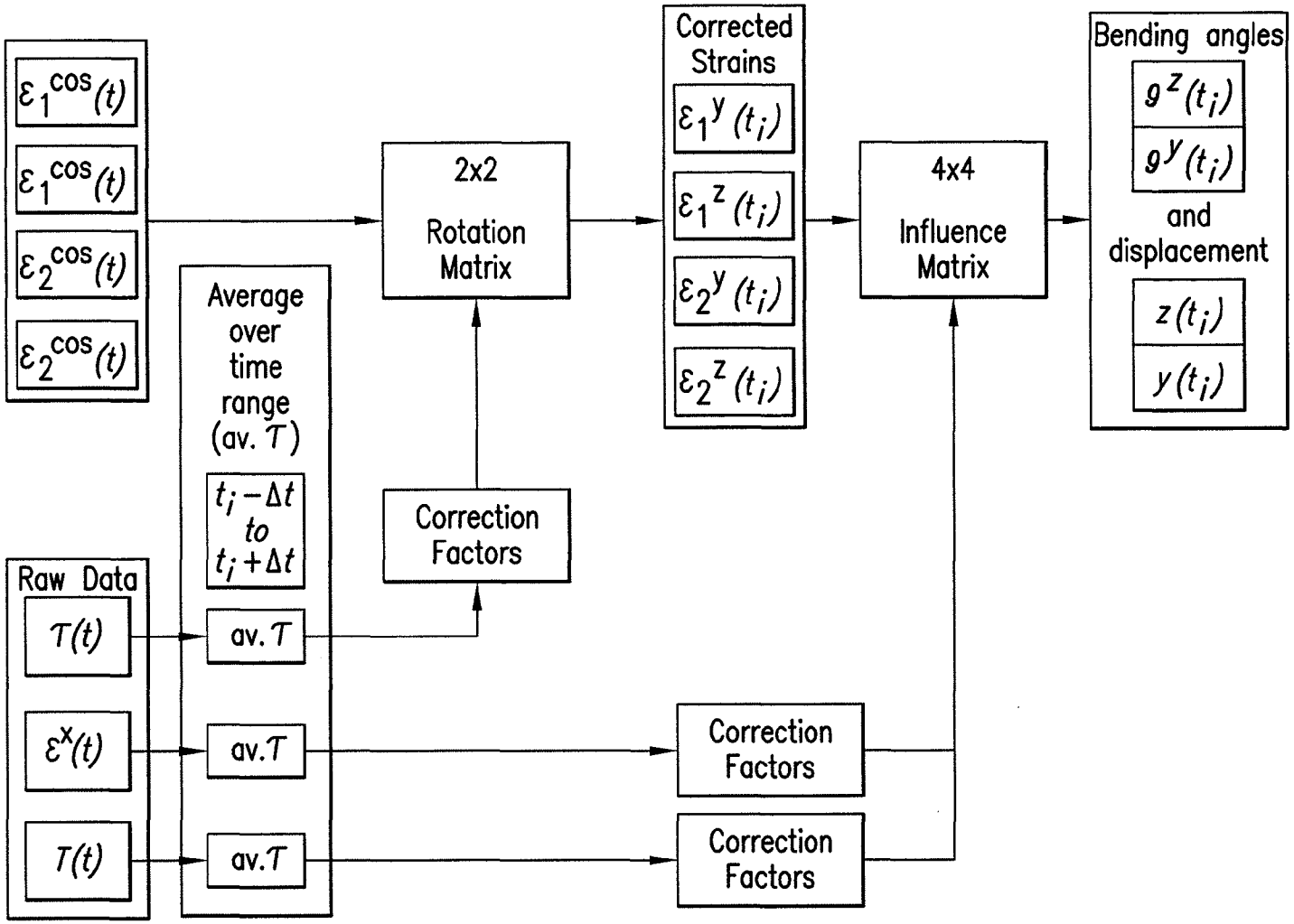
FIG. 10 is a block diagram of strain gauge data reduction for a CSN device as shown in FIG. 8, in accordance with the invention.

FIG. 10 shows a block diagram for data reduction in a strain gauge CSN device 10, such as that shown in FIG. 9. Calibration of the bending beam 32 of the CSN device 10 should provide coefficients that define angle and deflection of the leading centralizer 14*c* with respect to the trailing centralizer 14*a*, as follows:

$$y = \epsilon_1^Y \cdot p_1^Y + \epsilon_2^Y \cdot p_2^Y$$

$$z = \epsilon_1^Z \cdot p_1^Z + \epsilon_2^Z \cdot p_2^Z$$

$$\Theta^Y = \epsilon_1^Y \cdot p_1^{Y\Theta} + \epsilon_2^Y \cdot p_2^{Y\Theta}$$

$$\Theta^Z = \epsilon_1^Z \cdot p_1^{Z\Theta} + \epsilon_2^Z \cdot p_2^{Z\Theta} \quad \text{(Eq. 18)}$$

where coefficients $p_i^{\alpha}$ are determined during calibration. These coefficients are referred to as the 4×4 Influence Matrix in FIG. 10. Additional complications can be caused by the fact that the CSN device 10 may be under tension and torsion loads, as well as under thermal loads, during normal usage. Torsion load correction has a general form:

$$\begin{bmatrix} \varepsilon_j^Y \\ \varepsilon_j^Z \end{bmatrix}_{Corrected} = \begin{bmatrix} \cos(p^{\tau}\tau) & -\sin(p^{\tau}\tau) \\ \sin(p^{\tau}\tau) & \cos(p^{\tau}\tau) \end{bmatrix} \cdot \begin{bmatrix} \varepsilon_j^Y \\ \varepsilon_j^Z \end{bmatrix} \quad \text{(Eq. 19)}$$

where $\tau$ is the torsion applied to a CSN device 10 segment 13 as measured by a torsion detector and $p_{\tau}$ is a calibration constant. The factors in Eq. 19 are the 2×2 rotation matrix in FIG. 10.

Still referring to FIG. 10, the thermal loads change the values of factors $p_i^{\alpha}$. In the first approximation, the values are described by:

$$p_{j_{Correctd}}^{\alpha} = (1 + CTE_X \cdot \Delta T) \cdot p_j^{\alpha}$$

$$p_{j_{Correctd}}^{\alpha\Theta} = (1 + CTE_{\Theta} \cdot \Delta T) \cdot p_j^{\alpha} \quad \text{(Eq. 20)}$$

The CTE's are calibration parameters. They include both material and material stiffness thermal dependences. Each value of $p_i^{\alpha}$ has its own calibrated linear dependence on the axial strain loads, as follows:

$$p_{j_{Correctd}}^{\alpha} = (1 + Y_j^{\alpha} \cdot \epsilon_X) \cdot p_j^{\alpha}$$

$$p_{j_{Correctd}}^{\alpha\Theta} = (1 + Y_j^{\alpha\Theta} \cdot \epsilon_X) \cdot p_j^{\alpha} \quad \text{(Eq. 21)}$$

The correction factors described in the previous two equations of Eq. 21 are referred to as Correction Factors in FIG. 10.

Figure 11:
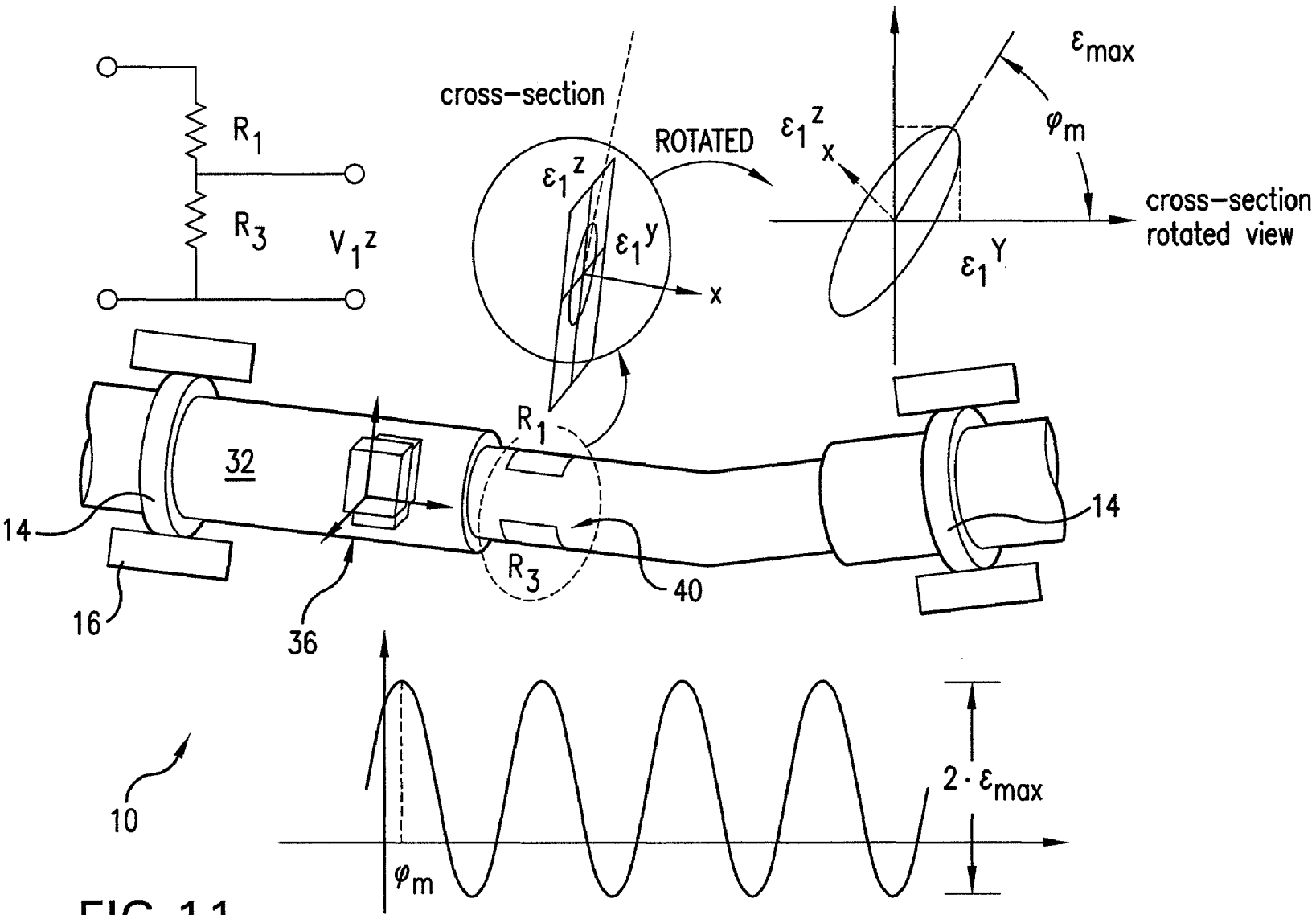
FIG. 11 shows strains exhibited in a rotating bending beam of a CSN device in accordance with the invention.

Now referring to FIG. 11, if the strain gauge detectors 40 can be placed on an axially rotating beam 32 constrained at the centralizers 14 by fixed immovable borehole 16 walls forming a sensor string segment 12. Advantages in greater overall measurement accuracy from CSN device 10 that may be gained by rotating the beam 32 to create a time varying signal related to the amount of bending to which it is subjected may result from, but are not limited to, signal averaging over time to reduce the effects of noise in the signal and improved discrimination bending direction. The signals created by a single bridge of strain gauge detectors 40 will follow an oscillating pattern relative to rotational angle $\phi$ and $\phi_m$, and the value of the strain registered by the strain gauge detectors 40 can be calculated by:

$$\epsilon(\phi) = \epsilon_{max} \sin(\phi - \phi_m - \psi) = \epsilon^{sin} \sin(\phi) + \epsilon^{cos} \cos(\phi) + \epsilon_{offset} \quad \text{(Eq. 22)}$$

where $\phi$ and $\phi_m$ are defined in FIG. 11 and $\psi$ is the angular location of the strain detector 40.

One can recover the value of the maximum strain and the orientation of the bending plane by measuring the value of the strain over a period of time. Eq. 22 may be rewritten in the following equivalent form:

$$\varepsilon(\varphi) = [\sin\varphi \ \cos\varphi] \cdot \begin{bmatrix} \cos\psi & \sin\psi \\ -\sin\psi & \cos\psi \end{bmatrix} \cdot \begin{bmatrix} \varepsilon^z \\ \varepsilon^y \end{bmatrix} + \varepsilon_{offset} \quad \text{(Eq. 23)}$$

where $\epsilon^z$ and $\epsilon^y$ are strain caused by bending correspondingly in the "xz" and "yz" planes indicated in FIG. 11.

Thus, if the value $\epsilon(\phi)$ is measured, the values of the $\epsilon^z$ and $\epsilon^y$ may be recovered by first performing a least square fit of $\epsilon(\phi)$ into sine and cosine. One of the possible procedures is to first determine values of $\epsilon^{sin}$, $\epsilon^{cos}$, and $\epsilon_{offset}$ by solving equations:

$$\begin{cases} \varepsilon_C = \varepsilon^{sin} \cdot CC + \varepsilon^{cos} \cdot CS + \varepsilon_{offset} \cdot C \\ \varepsilon_S = \varepsilon^{sin} \cdot CS + \varepsilon^{cos} \cdot SS + \varepsilon_{offset} \cdot S \\ \varepsilon_{dc} = \varepsilon^{sin} \cdot C + \varepsilon^{cos} \cdot S + \varepsilon_{offset} \cdot T \end{cases} \quad \text{(Eq. 24)}$$

where:

$$\varepsilon_S = \int_0^T \varepsilon(\varphi) \cdot \sin(\varphi) \cdot d\varphi(t) \quad \text{(Eqs. 25)}$$

$$\varepsilon_C = \int_0^T \varepsilon(\varphi) \cdot \cos(\varphi) \cdot d\varphi(t)$$

$$\varepsilon_{dc} = \int_0^T \varepsilon(\varphi) \cdot d\varphi(t)$$

$$CC = \int_0^T \cos(\varphi) \cdot \cos(\varphi) \cdot d\varphi(t)$$

$$SC = \int_0^T \sin(\varphi) \cdot \cos(\varphi) \cdot d\varphi(t)$$

$$SS = \int_0^T \sin(\varphi) \cdot \sin(\varphi) \cdot d\varphi(t)$$

$$C = \int_0^T \cos(\varphi) \cdot \varphi(t)$$

$$S = \int_0^T \sin(\varphi) \cdot \varphi(t)$$

The values of $\epsilon^y$ and $\epsilon^z$ can be recovered from:

$$\begin{bmatrix} \varepsilon^z \\ \varepsilon^y \end{bmatrix} = \begin{bmatrix} \cos\psi & -\sin\psi \\ \sin\psi & \cos\psi \end{bmatrix} \cdot \begin{bmatrix} \varepsilon^{sin} \\ \varepsilon^{cos} \end{bmatrix} \quad \text{(Eq. 26)}$$

The matrix in Eq. 26 is an orientation matrix that must be determined by calibrated experiments for each sensor string segment 12.

Figure 12:
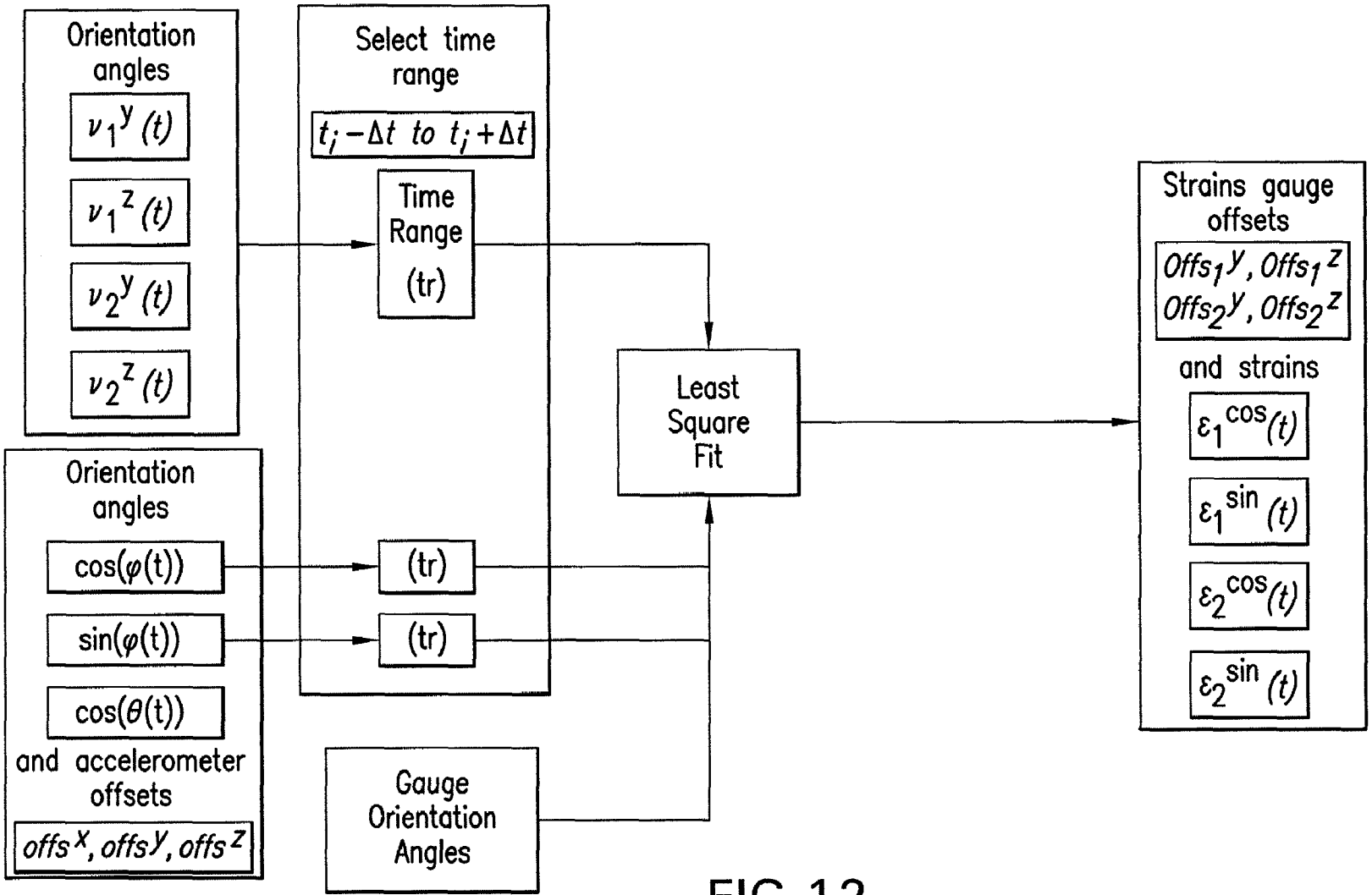
FIG. 12 is a block diagram illustrating how data reduction can be performed in a rotating strain gauge CSN device, such as illustrated in FIG. 11, in accordance with the invention.

Now referring to FIG. 12, the block diagram shows a reduction algorithm for the rotating strain gauge 40 data. Since the strain gauge 40 bridges have an unknown offset, Eq. 23 will have a form as follows:

$$\epsilon(\phi) = (\epsilon_{max} + \text{error}) \cdot \sin(\phi - \phi_m - \psi) + \text{offset} \quad \text{(Eq. 27)}$$

Correspondingly, $\epsilon^Y$ and $\epsilon^Z$ are determined by solving the least square fit into equations Eq. 26, where:

$$\sum_i error_i^2 = \min \quad \text{(Eq. 28)}$$

In a more general case, where two approximately orthogonal bridges (a and b) are used to measure the same values of $\epsilon^Y$ and $\epsilon^Z$, then a more general least square fit procedure may be performed instead of the analytic solution of the least square fit described by Eq. 28 for a single bridge situation. The minimization function is as follows:

$$\begin{cases} \varepsilon^a(\varphi) = \varepsilon_{max} \cdot \sin(\varphi - \varphi_m - \psi^a) + offset^a + error^a \\ \varepsilon^b(\varphi) = \varepsilon_{max} \cdot \sin(\varphi - \varphi_m - \psi^b) + offset^b + error^b \end{cases} \quad \text{(Eq. 29)}$$

$$\sum_i (error_i^a)^2 + (error_i^b)^2 = \min$$

where indexes a and b refer to the two bridges (of strain gauge detectors 40, FIG. 9), index i refers to the measurement number, and $\psi^a$ and $\psi^b$ are the Gauge Orientation Angles in FIG. 12 and Eq. 29. The Gauge Orientation Angles shown in FIG. 12 are determined by calibrated experiments for each sensor string segment 12.

Figure 13:
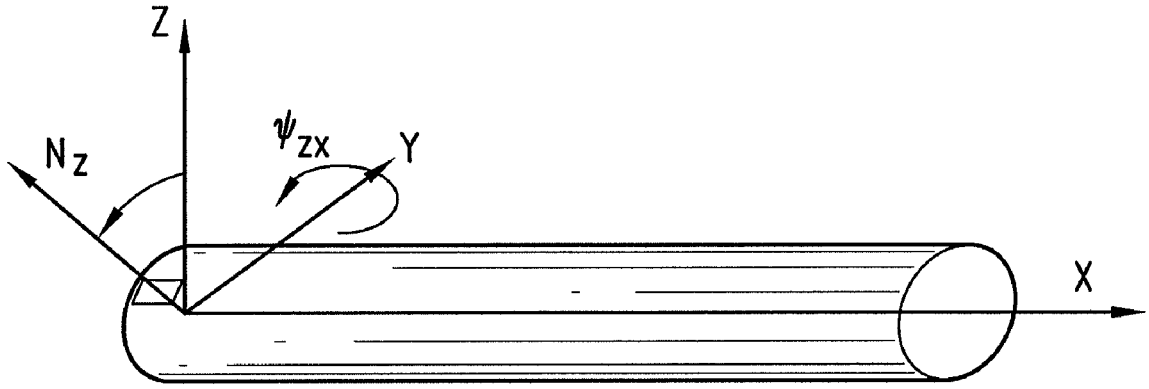
FIG. 13 shows vectors defining sensitivity of an accelerometer used with a CSN device in accordance with the invention.

Now referring to FIG. 13, which relates to the accelerometer 36 described above as incorporated into the CSN device 10 electronics package as discussed in relation to FIGS. 7*a* and 8. A tri-axial accelerometer 36 can be fully described by the following data where, relative to the Global vertical direction "Z," each component of the accelerometer has a calibrated electrical output (Gauge factor), a known, fixed spatial direction relative to the other accelerometer 36 components (Orientation), and a measured angle of rotation about its preferred axis of measurement (Angular Location):

| | Gauge factor | Angular Location | Orientation |
|---|---|---|---|
| Accelerometer X | mV/g | $\psi_{yz}$ | $N_X$, $N_Y$, $N_Z$ |
| Accelerometer Y | mV/g | $\psi_{yz}$ | $N_X$, $N_Y$, $N_Z$ |
| Accelerometer Z | mV/g | $\psi_{yz}$ | $N_X$, $N_Y$, $N_Z$ |

The coordinate system and the angles are defined in FIG. 13. Based on the definition of the local coordinate system, rotation matrices may be defined as:

$$R_{zy}(\varphi_{ZY}) = \begin{Vmatrix} 1 & 0 & 0 \\ 0 & \cos(\varphi_{ZY}) & -\sin(\varphi_{ZY}) \\ 0 & \sin(\varphi_{ZY}) & \cos(\varphi_{ZY}) \end{Vmatrix} \quad \text{(Eq. 30)}$$

$$R_{zx}(\varphi_{ZX}) = \begin{Vmatrix} \cos(\varphi_{ZX}) & 0 & -\sin(\varphi_{ZX}) \\ 0 & 1 & 0 \\ \sin(\varphi_{ZX}) & 0 & \cos(\varphi_{ZX}) \end{Vmatrix} \quad \text{(Eq. 31)}$$

$$\vec{g} = \begin{vmatrix} 0 \\ 0 \\ -g \end{vmatrix}$$

Thus, for a CSN device 10 going down a borehole 16 at an angle $\phi_{YZ} = -\theta$ after it has been turned an angle $\phi_{zy} = \phi$, the readings of the accelerometer 36 located on the circumference of a CSN device 10 can be determined as:

$$a = |\,N_z \quad N_y \quad N_z\,| \cdot R_{zy}(\varphi+\psi_{zy}) \cdot R_{zx}(-\theta) \cdot \begin{vmatrix} 0 \\ 0 \\ -g \end{vmatrix} \tag{Eq. 32}$$

$$a = |\,N_z \quad N_y \quad N_z\,| \cdot \begin{vmatrix} \sin(\theta) \\ \sin(\varphi+\psi_{zy})\cos(\theta) \\ \cos(\varphi+\psi_{zy})\cos(\theta) \end{vmatrix} \cdot g$$

$$a = c_o \cdot g \cdot \sin(\theta) + g \cdot \cos(\theta) \cdot (c_1 \cdot \sin(\varphi) + c_2 \cdot \cos(\varphi))$$

where fit parameters $c_0$, $c_1$, and $c_2$ are determined during initial calibration of the tri-axial accelerometer 36 and g is the Earth's gravitational constant. The equations describing all three accelerometer 36 readings will have the following form:

$$\begin{cases} \dfrac{a^X}{g} = \cos(\theta) \cdot (c_1^X \cdot \sin(\varphi) + c_2^X \cdot \cos(\varphi)) + c_o^X \cdot \sin(\theta) \\ \dfrac{a^Y}{g} = \cos(\theta) \cdot (c_1^Y \cdot \sin(\varphi) + c_2^Y \cdot \cos(\varphi)) + c_o^Y \cdot \sin(\theta) \\ \dfrac{a^Z}{g} = \cos(\theta) \cdot (c_1^Z \cdot \sin(\varphi) + c_2^Z \cdot \cos(\varphi)) + c_o^Z \cdot \sin(\theta) \end{cases} \tag{Eq. 33}$$

For ideal accelerometers 36 with ideal placements $\psi_{zy}=0$, Eq. 33 reduces to:

$$\frac{a^X}{g} \approx \sin(\theta) \tag{Eq. 34}$$

$$\frac{a^Y}{g} \approx \cos(\theta) \cdot \sin(\varphi)$$

$$\frac{a^Z}{g} \approx \cos(\theta) \cdot \cos(\varphi)$$

Figure 14:
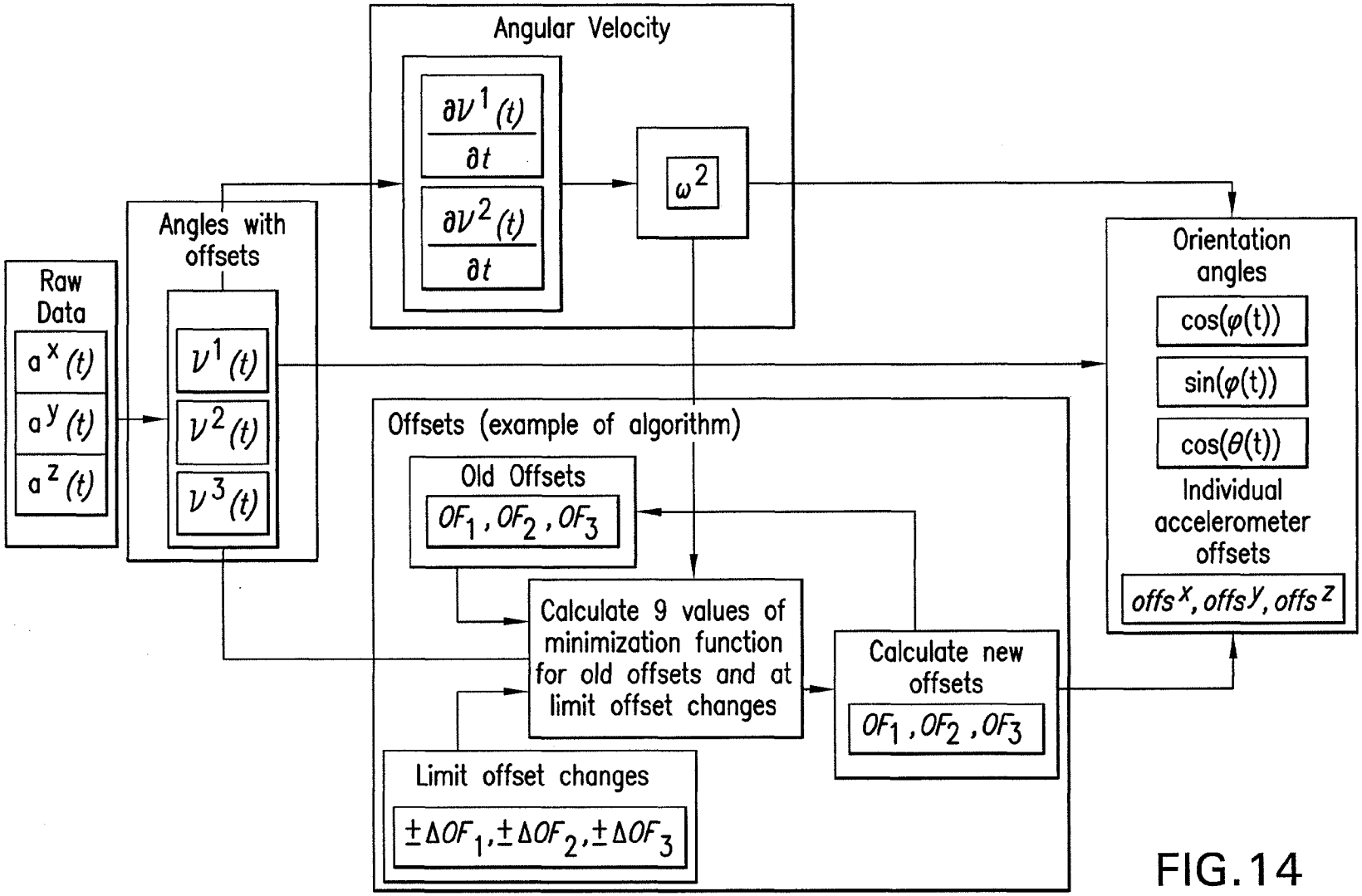
FIG. 14 is a block diagram showing how data reduction can be performed in an accelerometer used with a CSN device in accordance with the invention.

Now referring to FIG. 14, a data reduction algorithm as shown corrects accelerometer 36 readings for zero offset drift and angular velocity. Such an algorithm can be used by a zero drift compensator, including a processor, with a CSN device 10 as shown in FIG. 11, for example. The zero drift compensator works by rotating the CSN device 10. A zero drift compensator can operate by enforcing a rule that the average of the measured value of g be equal to the known value of g at a given time. Alternatively, a zero drift compensator can operate by enforcing a rule that the strain readings of the strain gauges 40 follow the same angular dependence on the rotation of the string 12 as the angular dependence recorded by the accelerometers 36. Alternatively, a zero drift compensator can operate by enforcing a rule that the strain readings of the strain gauges 40 follow a same angular dependence as that measured by angular encoders placed on the drill string 18 (FIG. 1) or sensor string 12.

Because the zero offset of the accelerometers will drift and/or the accelerometers 36 are mounted on a rotating article, a more accurate description of the accelerometer reading would be:

$$a^\alpha = c_0^\alpha \cdot g \cdot \sin(\theta) + g \cdot \cos(\theta) \cdot (c_1^\alpha \cdot \sin(\phi) + c_2^\alpha \cdot \cos(\phi)) + \mathrm{off}^\alpha + c_3^\alpha \cdot \omega^2 \tag{Eq. 35}$$

where off is the zero offset of the accelerometer, ω is the angular velocity of rotation, and index α refers to the local x, y, and z coordinate system. Equation 35 can be solved for the angles. The solution has a form:

$$\begin{cases} \cos(\theta) \cdot \sin(\varphi) = d_1^X \cdot a^X + d_1^Y \cdot a^Y + d_1^Z \cdot a^Z - d_1^\omega \cdot \omega^2 \\ \cos(\theta) \cdot \cos(\varphi) = d_2^X \cdot a^X + d_2^Y \cdot a^Y + d_2^Z \cdot a^Z - d_2^\omega \cdot \omega^2 \\ \sin(\theta) = d_3^X \cdot a^X + d_3^Y \cdot a^Y + d_3^Z \cdot a^Z - d_3^\omega \cdot \omega^2 \end{cases} \tag{Eq. 36}$$

The values of the twelve constants $d_j^\alpha$ are determined during calibration. Equations 36 are subject to a consistency condition:

$$\cos^2(\theta) \cdot \sin^2(\phi) + \cos^2(\theta) \cdot \cos^2(\phi) + \sin^2(\theta) = 1 \tag{Eq. 37}$$

The notation may be simplified if one defines variables, as follows:

$$\begin{cases} V_i^1 = d_1^X \cdot a_i^X + d_1^Y \cdot a_i^Y + d_1^Z \cdot a_i^Z \\ V_i^2 = d_2^X \cdot a_i^X + d_2^Y \cdot a_i^Y + d_2^Z \cdot a_i^Z \\ V_i^3 = d_3^X \cdot a_i^X + d_3^Y \cdot a_i^Y + d_3^Z \cdot a^Z \end{cases} \tag{Eq. 38}$$

$$\begin{cases} OF_1 = d_1^X \cdot off^X + d_1^Y \cdot off^Y + d_1^Z \cdot off^Z \\ OF_2 = d_2^X \cdot off^X + d_2^Y \cdot off^Y + d_2^Z \cdot off^Z \\ OF_3 = d_3^X \cdot off^X + d_3^Y \cdot off^Y + d_3^Z \cdot off^Z \end{cases}$$

where index i refers to each measurement performed by the accelerometers. Note that offsets $OF_1$, $OF_2$, $OF_3$ are independent of measurements and do not have index i. Consistency condition Eq. 37 can be rewritten as:

$$(V_i^1 - OF_1 - d_1^\omega \cdot \omega^2)^2 + (V_i^2 - OF_2 - d_2^\omega \cdot \omega^2)^2 + (V_i^3 - OF_3 - d_3^\omega \cdot \omega^2)^2 = 1 \tag{Eq. 39}$$

Since ω is small and the value of $\cos(\theta) \approx 1$, the value of ω is determined using:

$$\omega^2 = \frac{\left(\frac{\partial V_i^1}{\partial t}\right)^2 + \left(\frac{\partial V_i^2}{\partial t}\right)^2}{\cos^2(\theta_i)} \approx \frac{\left(\frac{\partial V_i^1}{\partial t}\right)^2 + \left(\frac{\partial V_i^2}{\partial t}\right)^2}{1 - (V_i^3)^2} \approx \left(\frac{\partial V_i^1}{\partial t}\right)^2 + \left(\frac{\partial V_i^2}{\partial t}\right)^2 \tag{Eq. 40}$$

The necessity for any correction for $\cos(\theta) \neq 1$ must be determined experimentally to evaluate when deviation from this approximation becomes significant for this application.

Since the accelerometers 36 have a zero offset that will change with time, equation 40 will not be satisfied for real measurements. The value of offsets $OF_1$, $OF_2$, $OF_3$, are determined by the least square fit, i.e., by minimizing, as follows:

$$\min\left(\sum_i \left[(V_i^1 - OF_1 - d_1^\omega \cdot \omega^2)^2 + (V_i^2 - OF_2 - d_2^\omega \cdot \omega^2)^2 + (V_i^3 - OF_3 - d_3^\omega \cdot \omega^2)^2 - 1\right]^2\right) \tag{Eq. 41}$$

Once the values of the offsets $OF_1$, $OF_2$, $OF_3$ are determined, the rotation angle can be defined as:

$$\sin(\varphi_i) = \frac{V_i^1 - OF_1 - d_1^{\omega} \cdot \omega^2}{\sqrt{(V_i^1 - OF_1 - d_1^{\omega} \cdot \omega^2)^2 + (V_i^2 - OF_2 - d_2^{\omega} \cdot \omega^2)^2}} \quad \text{(Eq. 42)}$$

$$\cos(\varphi_i) = \frac{V_i^2 - OF_2 - d_2^{\omega} \cdot \omega^2}{\sqrt{(V_i^1 - OF_1 - d_1^{\omega} \cdot \omega^2)^2 + (V_i^2 - OF_2 - d_2^{\omega} \cdot \omega^2)^2}}$$

When values of the offsets $OF_1$, $OF_2$, $OF_3$ are known, the values of offsets of individual accelerometers 36 and the values of $\phi_i$ and $\cos(\theta_i)$ can be determined.

Figure 15:
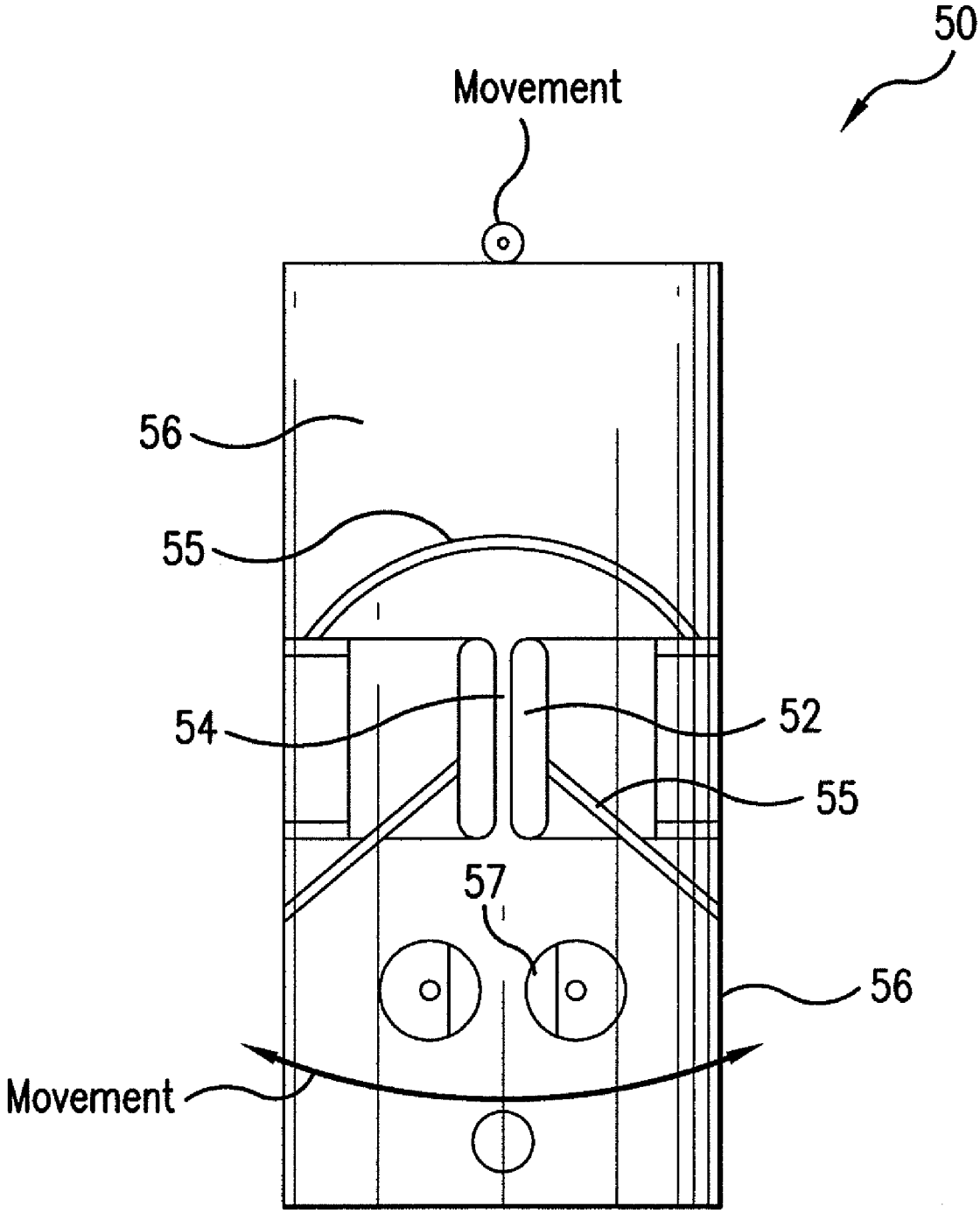
FIGS. 15 to 17 show a universal joint strain gauge CSN device in accordance with the invention.
Figure 16:
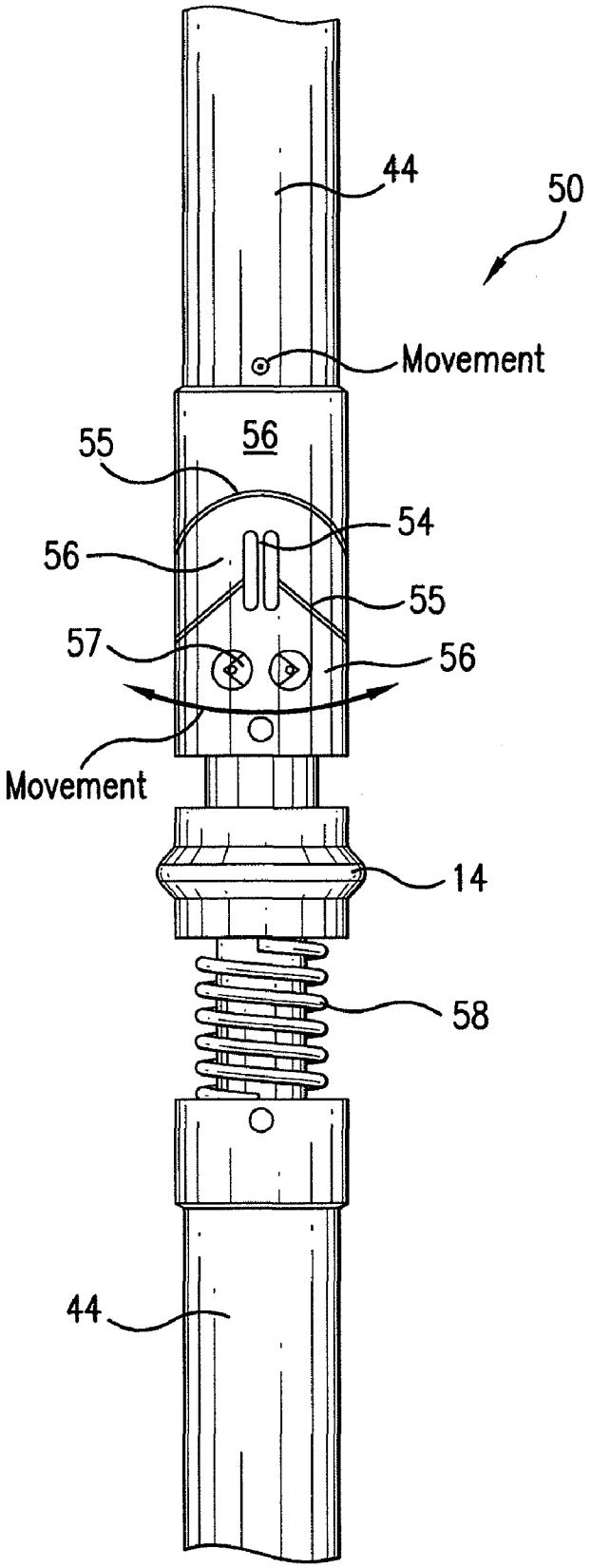
Figure 17:
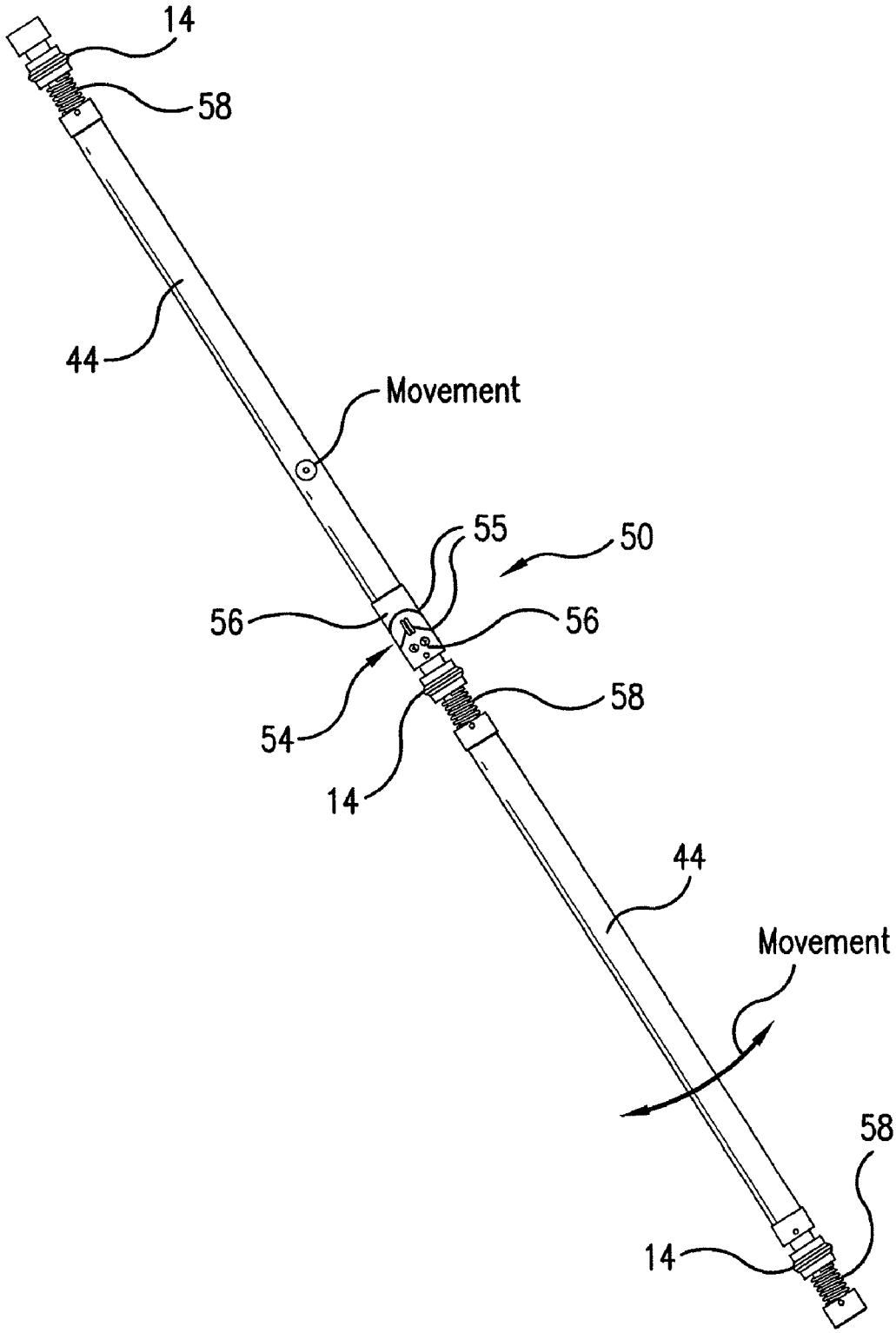

Now referring to FIGS. 15-17, each of which shows a universal joint angle measurement sensor 50, which is an alternative embodiment to the strain gauge displacement CSN device 10 embodiments discussed above in relation to, e.g., FIGS. 2*c* and 8. As shown in FIG. 15, the universal joint 50 can be cylindrical in shape to fit in a borehole 16 or tube and is comprised of two members 56 joined at two sets of opposing bendable flexures 54 such that the joint 50 may bend in all directions in any plane orthogonal to its length. The bendable flexures 54 are radially positioned with respect to an imaginary center axis of the universal joint 50. Each one of the two sets of bendable flexures 54 allows for flex in the joint 50 along one plane along the imaginary center axis. Each plane of flex is orthogonal to the other, thus allowing for flex in all directions around the imaginary center axis. The strain forces at the bendable flexures 54 are measured in much the same way as those on the strain gauge detectors 40 of the CSN device 10 of FIG. 8 using detectors 52. Spatial orientation of universal joint 50 relative to the vertical may be measured by a tri-axial accelerometer 57 attached to the interior of universal joint 50.

The universal joint 50 may be connected to a middle centralizer 14*b* of a CSN device 10 as shown in FIG. 16. A spring 58 can be used to activate the centralizer 14*b* (this will be explained in further detail below with reference to FIGS. 19-20*b*). The universal joint 50 and middle centralizer 14*b* are rigidly attached to each other and connected with arms 44 to leading and trailing centralizers 14*a* and 14*c*.

As shown in FIG. 17, the universal joint 50, when located on a CSN device 10 for use as a downhole tool for survey and/or navigation, is positioned at or near a middle centralizer 14*b* of three centralizers 14. The two outer centralizers 14*a* and 14*c* are connected to the universal joint 50 by arms 44, as shown in FIG. 17, which may house electronics packages if desired. The universal joint 50 includes strain gauges 52 (FIG. 15) to measure the movement of the joint members 56 and arms 44.

Figure 18:
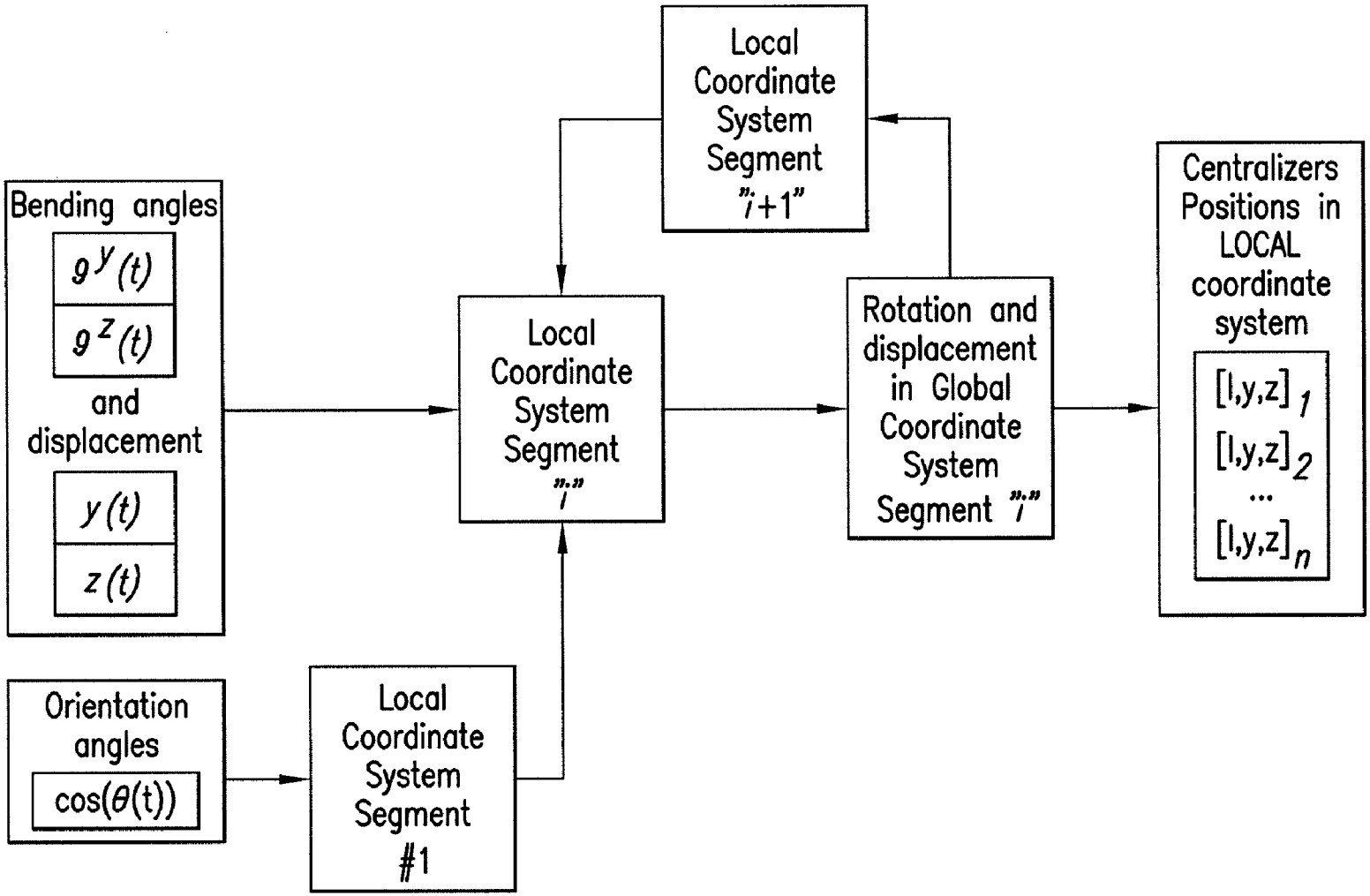
FIG. 18 is a block diagram of a CSN assembly in accordance with the invention.

As discussed above, the CSN device 10 of the various embodiments of the invention is used for the survey of boreholes 16 or passageways and navigation of downhole devices; the goal of the navigation algorithm (FIG. 6) is to determine relative positions of the centralizers 14 of the CSN device 10 and to determine the borehole 16 location of the CSN device 10 based on that data. Now referring to FIG. 18, which is a block diagram of the assembly of a CSN device 10, the first local coordinate system (#1) has coordinate vectors as follows:

$$\vec{X} = \begin{bmatrix} \cos\theta \\ 0 \\ -\sin\theta \end{bmatrix} \quad \vec{Y} = \begin{bmatrix} 0 \\ 1 \\ 0 \end{bmatrix} \quad \text{(Eq. 43)}$$

$$\vec{Z} = \begin{bmatrix} \sin\theta \\ 0 \\ \cos\theta \end{bmatrix} \quad \vec{g} = \begin{bmatrix} 0 \\ 0 \\ -1 \end{bmatrix}$$

where cos θ is determined by the accelerometers 57 and g is the Earth gravity constant. Given a local coordinate system (FIGS. 5*a*-5*d*) with point of origin $\vec{r}_i$ and orientation of x-axis $\vec{X}_i \uparrow\uparrow \vec{a}_i$, and the length L of an arm 44, the orientation of axis would be:

$$\begin{cases} \vec{X}_i = \dfrac{\vec{a}_i}{|\vec{a}_i|} \\ \vec{Z}_i = \dfrac{-\vec{g} + \vec{X}_i \cdot (\vec{X}_i \cdot \vec{g})}{|-\vec{g} + \vec{X}_i \cdot (\vec{X}_i \cdot \vec{g})|} \\ \vec{Y}_i = \vec{Z}_i \times \vec{X}_i \end{cases} \quad \text{(Eq. 44)}$$

Referring again to FIG. 5*d*, which shows the local coordinate system previously discussed above, the reading of strain gauges, e.g., 52 as shown in FIG. 15, provide the angles $\Theta^y$, $\Theta^z$ of the CSN device 10 segment leading centralizer 14*c* position in the local coordinate system. Correspondingly, the origin of the next coordinate system and the next centralizer 14*b* would be:

$$\vec{r}_{i+1} = \vec{r}_i + \vec{X}_i\left(L_i - \frac{2}{3} \cdot \frac{y_i^2 + z_i^2}{L_i}\right) + \vec{Y}_i \cdot y_i + \vec{Z}_i \cdot z \quad \text{(Eq. 45)}$$

The orientation of the next coordinate system will be defined by Eq. 46 where the new vectors are:

$$\vec{a}_{i+1} = a_i + \tan(\Theta_i^Y) \cdot \vec{Y}_i + \tan(\Theta_i^Z) \cdot \vec{Z}_i$$

and $$\vec{g} = \begin{bmatrix} 0 \\ 0 \\ -1 \end{bmatrix} \quad \text{(Eq. 46)}$$

Using Eq. 45 and 46, one can define the origin and the orientation of the CSN device 10 portion in the unknown region of a borehole 16 in the first local coordinate system. After applying equations 45 and 46 to all CSN device 10 segments 13, the location of the CSN device 10 portion in the unknown region of a borehole 16 is determined. The shape of the CSN device 10 is defined up to the accuracy of the strain gauges 40 or 52. The inclination of the CSN device 10 with respect to the vertical is defined within the accuracy of the accelerometers 36 or 57. The azimuth orientation of the CSN device 10 is not known.

Figure 20A:
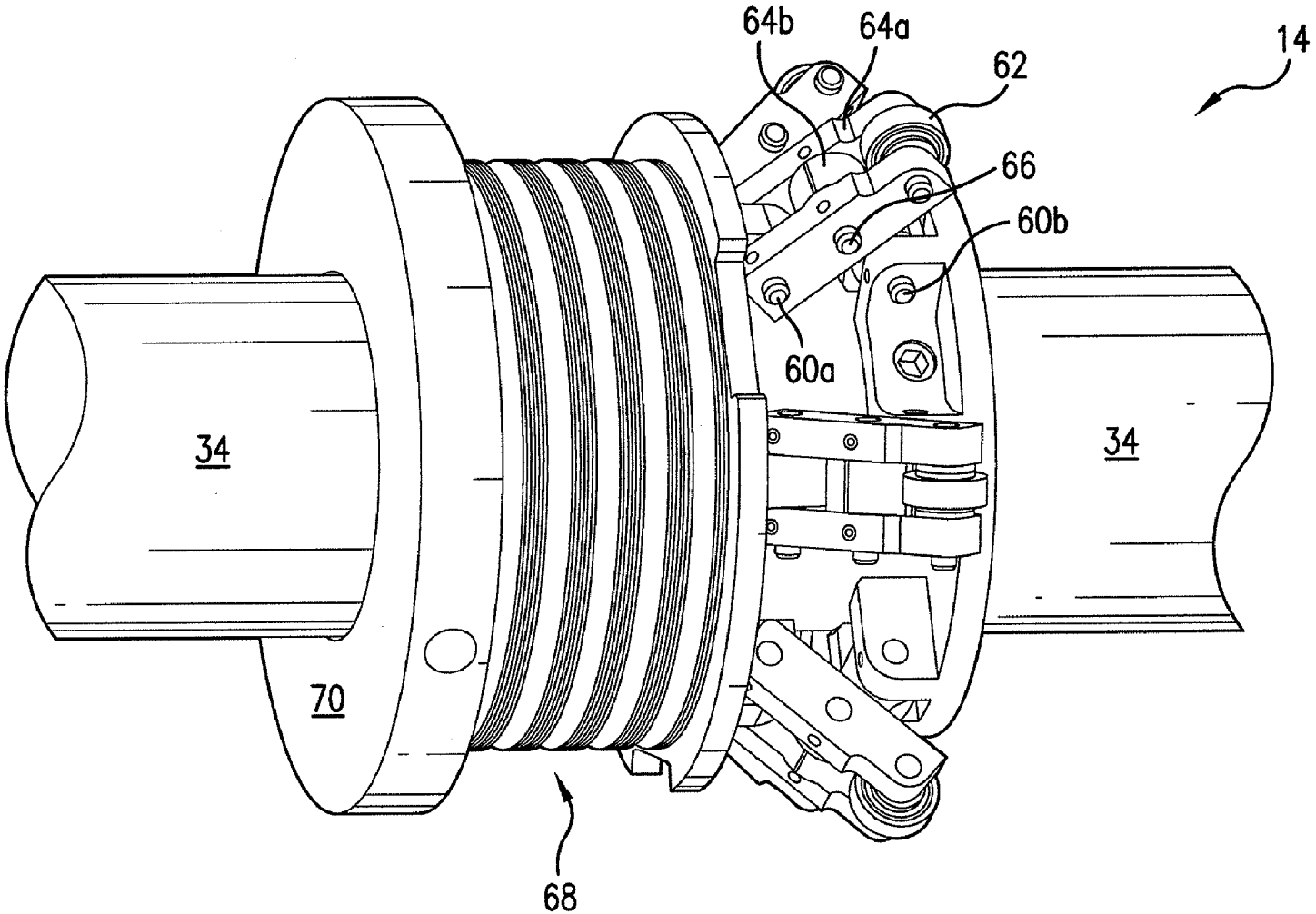
Figure 20B:
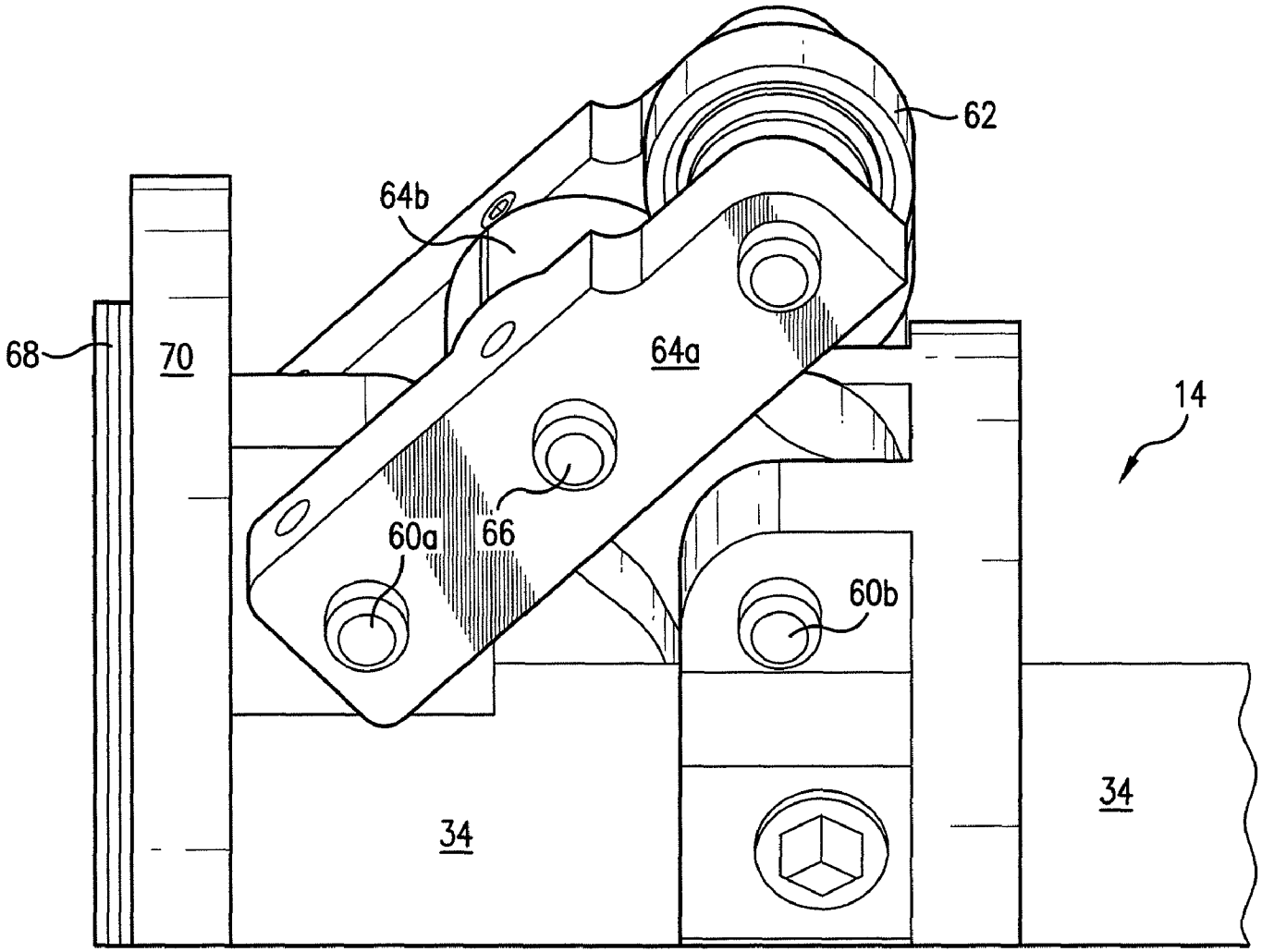

Now referring to FIGS. 19, 20*a*, and 20*b*, embodiments of centralizers for use with CSN devices 10 are shown. As previously discussed, centralizers 14 are used to accurately and repeatably position the metrology sensors 28 (FIG. 1) discussed above within a borehole 16. Additionally, the centralizer 14 has a known pivot point 60 that will not move axially relative to the metrology article to which it is attached. The centralizer 14 is configured to adapt straight line mechanisms to constrain the centralizer 14 pivot point 60 to axially remain in the same lateral plane. This mechanism, sometimes referred to as a "Scott Russell" or "Evan's" linkage, is composed of two links, 64 as shown in FIG. 19, and 64*a* and 64*b* as shown in FIGS. 20*a* and 20*b*. The shorter link 64*b* of FIGS. 20*a* and 20*b* has a fixed pivot point 60*b*, while the longer link 64*a* has a pivot point 60*a* free to move axially along the tube housing 34. The links 64*a* and 64*b* are joined at a pivot point 66, located half-way along the length of the long link 64*a*, while the short link 64*b* is sized so that the distance from the fixed point 60*b* to the linked pivot 66 is one half the length of the long link 64*a*.

This centralizer 14 mechanism is formed by placing a spring 68 behind the sliding pivot point 60*a*, which provides an outward forcing load on the free end of the long link 64*a*. This design can use roller bearings at pivot points, but alternatively they could be made by other means, such as with a flexure for tighter tolerances, or with pins in holes if looser tolerances are allowed. A roller 62 is positioned at the end of the long link 64*a* to contact the borehole 16 wall.

According to this centralizer 14 concept, all pivot points are axially in line with the pivot point 60*b* of the short link 64*b*, and thus, at a known location on the CSN device 10. Additionally, this mechanism reduces the volume of the centralizer 14. FIG. 19 shows a centralizer 14 embodiment with a double roller, fixed pivot point 60. This embodiment has two spring-loaded 68 rollers 62 centered around a fixed pivot point 60. FIGS. 20*a* and 20*b* have a single roller structure, also with a single fixed pivot point 60, but with one spring-loaded 68 roller 62.

Figure 21A:
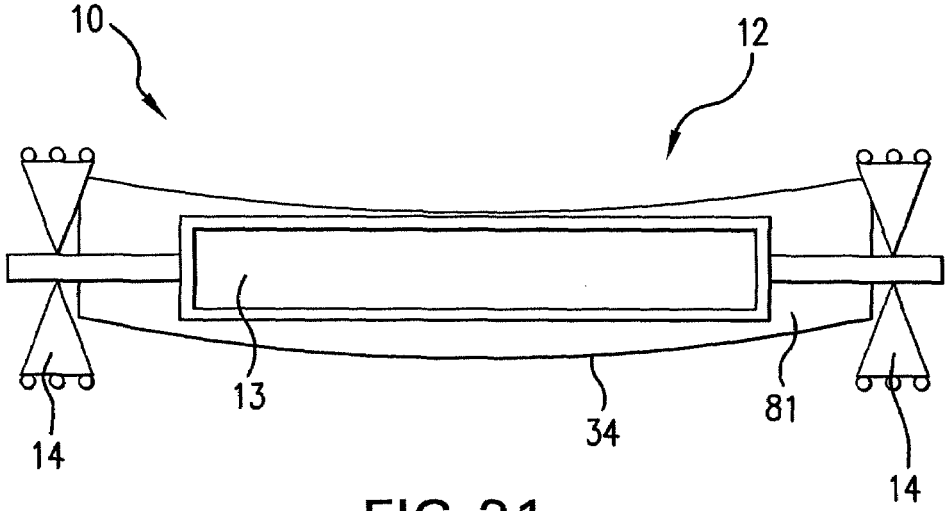
FIGS. 21*a* and 21*b* show gravity compensating CSN devices.
Figure 21B:
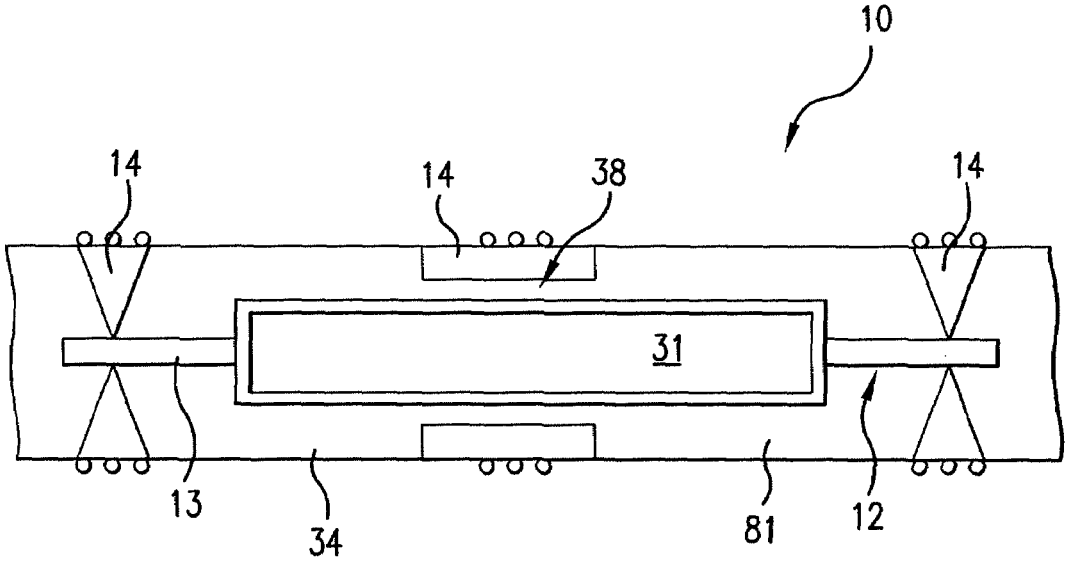

In an alternative embodiment of the invention, a device is utilized for canceling the effects of gravity on a mechanical beam to mitigate sag. As shown in FIGS. 21*a* and 21*b*, using buoyancy to compensate for gravity-induced sag of a metrology beam of a CSN device 10 having a proximity-detector-based or angular-metrology-based displacement sensor string, accuracy of the survey or navigation can be improved. As shown in FIG. 21*a*, an angle measuring metrology sensor CSN device 10 can enclose the sensor string segments 13 within a housing 34 containing a fluid 81. This fluid 81 provides buoyancy for the segments 13, thus mitigating sag. Alternatively, as shown in FIG. 21*b*, a displacement measuring metrology sensor CSN device 10 can likewise encase its straight beam 31 within a fluid 81 filled housing 34. In this way, sagging of the straight beam 31 is mitigated and with it errors in displacement sensing by the capacitor sensor 38 are prevented.

Various embodiments of the invention have been described above. Although this invention has been described with reference to these specific embodiments, the descriptions are intended to be illustrative of the invention and are not intended to be limiting. Various modifications and applications may occur to those skilled in the art without departing from the true spirit and scope of the invention as defined in the appended claims.

What is claimed as new and desired to be protected by Letters Patent of the United States is:

1. A metrology device, comprising:

at least one sensor string segment;

at least three centralizers for supporting said string segment, said at least three centralizers including a middle centralizer and at least two other centralizers;

at least one metrology sensor for measuring displacement of said string segment relative to said middle centralizer, and for generating metrology information corresponding to said displacement, said metrology sensor being associated with said middle centralizer and being located between said at least two other centralizers, and wherein said displacement of said string segment relative to said middle centralizer is caused by relative movement of said at least two other centralizers; and at least one odometry device for generating odometry information for determining, together with said displacement information, the position of said sensor string segment.

2. The metrology device of claim 1, further comprising an angle detector.

3. The metrology device of claim 2, wherein said angle detector is configured to measure the angle between first, second and third adjacent centralizers.

4. The metrology device of claim 3, wherein a first sensor string segment connects said first centralizer and said second centralizer, and a second sensor string segment connects said second centralizer and said third centralizer.

5. The metrology device of claim 1, wherein said metrology sensor is configured to measure the displacement of a straight beam relative to one of said at least three centralizers.

6. The metrology device of claim 1, further comprising a strain detector.

7. The metrology device of claim 6, wherein said strain detector is positioned on a first bending beam between a first centralizer and a second centralizer.

8. The metrology device of claim 7, wherein said strain detector comprises a first pair of strain gauges and a second pair of strain gauges.

9. The metrology device of claim 8, wherein each of said first and second pairs of strain gauges comprises a first gauge at a first position on said first bending beam and a second gauge at a second position on said first bending beam, each of said pairs of gauges being on opposite sides of the circumference of said first bending beam.

10. The metrology device of claim 7, further comprising a second strain detector positioned on a second bending beam between said second centralizer and a third centralizer.

11. The metrology device of claim 7, further comprising an accelerometer.

12. The metrology device of claim 1, wherein said metrology sensor includes an optical detector.

13. The metrology device of claim 12, wherein said optical detector comprises a laser.

14. The metrology device of claim 1, wherein said centralizers are each configured to position a portion of the metrology device in the geometrical center of a passageway through which said metrology device extends.

15. The metrology device of claim 1, further comprising a plurality of metrology detectors.

16. The metrology device of claim 15, wherein said plurality of metrology detectors comprises at least one angle detector and at least one displacement detector.

17. The metrology device of claim 15, wherein said plurality of metrology detectors comprises at least one displacement detector and at least one strain detector.

18. The metrology device of claim 15, further comprising means for calculating a local coordinate system of said device.

19. A downhole navigation device, comprising:

at least one sensor string segment;

at least three centralizers for supporting said string segment, a middle one of said at least three centralizers being located between two other ones of said at least three centralizers;

at least one metrology sensor for generating metrology information corresponding to said displacement within said metrology device, said metrology sensor being located between said two centralizers; and a tubular flexure-based universal joint connected to said string segment, said universal joint having plural peripheral flexure members; and wherein said metrology sensor includes strain detectors for detecting bending of said peripheral flexure members within said universal joint, and wherein said middle centralizer is associated with said universal joint.

20. The downhole navigation device of claim 19, wherein said universal joint comprises a first strain gauge at a first flexure and a second strain gauge at a second flexure, said first and second flexures being in orthogonal planes and being elements of said universal joint.

21. The downhole navigation device of claim 19, further comprising means for calculating the position of the navigation device.

22. The downhole navigation device of claim 19, further comprising an accelerometer.

23. The downhole navigation device of claim 19, wherein said universal joint is configured to measure the angle between the two centralizers of said at least three centralizers not associated with said universal joint.

* * * * *